US006746808B2

(12) United States Patent
Nakamura et al.

(10) Patent No.: US 6,746,808 B2
(45) Date of Patent: Jun. 8, 2004

(54) IMAGE FORMING COLOR TONER, COLOR IMAGE FORMING METHOD AND COLOR IMAGE FORMING APPARATUS

(75) Inventors: Yasushige Nakamura, Kawasaki (JP); Shinichi Yaoi, Kawasaki (JP); Tomoaki Tanaka, Kawasaki (JP); Yoshimichi Katagiri, Kawasaki (JP); Seijiro Ishimaru, Kawasaki (JP); Satoshi Takezawa, Kawasaki (JP); Sadaaki Yoshida, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 53 days.

(21) Appl. No.: 10/106,323

(22) Filed: Mar. 27, 2002

(65) Prior Publication Data

US 2003/0129516 A1 Jul. 10, 2003

(30) Foreign Application Priority Data

Aug. 29, 2001 (JP) ..... 2001-259915
Jan. 17, 2002 (JP) ..... 2002-008942

(51) Int. Cl.[7] ..... G03G 9/00

(52) U.S. Cl. ..... 430/108.21; 430/108.1; 430/45; 430/124

(58) Field of Search ..... 430/108.21, 108.1, 430/45, 124

(56) References Cited

U.S. PATENT DOCUMENTS

| | | | | |
|---|---|---|---|---|
| 4,548,886 | A | 10/1985 | Katagiri et al. | |
| 4,565,761 | A | 1/1986 | Katagiri et al. | |
| 4,752,548 | A | 6/1988 | Makino et al. | |
| 4,840,862 | A | 6/1989 | Makino et al. | |
| 5,296,439 | A | 3/1994 | Maruyama et al. | |
| 5,330,870 | A | 7/1994 | Tanaka et al. | |
| 5,409,797 | A | 4/1995 | Hosoi et al. | |
| 5,582,941 | A | 12/1996 | Kato et al. | |
| 5,747,217 | A | 5/1998 | Zaklika et al. | |
| 6,083,988 | A | 7/2000 | Becker | |
| 6,136,488 | A | 10/2000 | Kushino et al. | |
| 6,593,050 | B2 * | 7/2003 | Katagiri et al. | 430/108.23 |

FOREIGN PATENT DOCUMENTS

| | | |
|---|---|---|
| JP | A-61-156137 | 7/1986 |
| JP | A-1-217467 | 8/1989 |
| JP | A-1-275188 | 11/1989 |
| JP | A-120082 | 5/1990 |
| JP | A-4-250464 | 9/1992 |
| JP | A-4-331186 | 11/1992 |
| JP | A-5-107805 | 4/1993 |
| JP | 305054 | 3/1994 |
| JP | A-6-348056 | 12/1994 |
| JP | A-7-31413 | 2/1995 |
| JP | A-7-72663 | 3/1995 |
| JP | A-10-006643 | 1/1998 |
| JP | A-10-016416 | 1/1998 |
| JP | A-10-39535 | 2/1998 |
| JP | A-11-38666 | 2/1999 |
| JP | A-11-38667 | 2/1999 |
| JP | A-11-125928 | 5/1999 |
| JP | A-11-352718 | 12/1999 |
| JP | A-2000-035689 | 2/2000 |
| JP | A-2000-172008 | 6/2000 |
| JP | A-2000-214628 | 8/2000 |

* cited by examiner

*Primary Examiner*—Mark A. Chapman
(74) *Attorney, Agent, or Firm*—Westerman, Hattori, Daniels & Adrian LLP

(57) ABSTRACT

In a color toner for forming an image, comprising at least a binder resin and a colorant, light-absorbing fine composite particles comprising core particles and at least two coating layers having different refractive indexes laminated on the surface of the core particles or other IR-absorbing compounds such as an azulene compound having a specific structure are used as an infrared absorbing compound. The color toner is used in an electrophotographic color image forming apparatus using a photofixing system for fixing a toner image.

20 Claims, 2 Drawing Sheets

IMAGE FORMING COLOR TONER, COLOR IMAGE FORMING METHOD AND COLOR IMAGE FORMING APPARATUS

BACKGROUND OF THE INVENTION

1. Field of the Invention

The present invention relates to a color toner for forming an image and, more particularly, to a color toner suited for use in an image forming method employing a photofixing system. The color toner of the present invention can be used advantageously as a developing agent in various image forming apparatuses, employing various image forming systems such as electrography, electrophotography and ionography such as, for example, an electrophotographic copying machine, an electrophotographic facsimile, an electrophotographic printer and an electrostatic printing machine. The present invention also relates to a color image forming method and a color image forming apparatus which employ the color toner for forming an image.

2. Description of the Related Art

The image forming method employing electrophotography, which has been widely used in copying machines, printers and printing machines generally, begins by charging the surface of a photoconductive insulator such as a photosensitive drum uniformly with a positive or a negative electrostatic charge. After the uniform charging, the electrostatic charge on the insulating material is partially erased by irradiating the photoconductive insulator with image light, by various means, to thereby form an electrostatic latent image. For example, an electrostatic latent image corresponding to image information can be formed on the photoconductive insulator by erasing the surface charge from particular portions by irradiating it with a laser beam. Then a fine powder of developing agent, referred to as a toner, is caused to deposit on the latent image where the electrostatic charge remains on the photoconductive insulator, thereby to visualize the latent image. Lastly, in order to print the toner image obtained as described above, it is common to electrostatically transfer the image onto a recording medium such as recording paper.

On the other hand, according to image forming method employing ionography, ions are generated by an ion (charged particles) generating means employing a support drum having an electrostatic film as a dielectric member for supporting an electrostatic image and the electrostatic image is formed on the surface of the dielectric member by ions. The electrostatic image thus formed is visualized by developing with a toner. Finally, the resulting toner image is subjected to transfer and fixing steps in the same manner as in case of electrophotography described above to obtain a print.

In the image forming method described above, the fixing step is conducted by employing a common technique. For the fixation of the transferred toner image, such methods as a fixing method wherein toner is melted under pressure, by heating or by combination thereof and is then solidified or a fixing method wherein toner is melted by irradiating with light and is then solidified, have been employed, while much interest is being directed to a method referred to as a photofixing method (also referred to as a flash fixing method), which uses light, that is free from adverse effects of pressure and heating. In the photofixing method, since it is not necessary to apply pressure to the toner during fixation, the need to bring the toner into contact with a fixing roller or the like is eliminated, and such an advantage is provided that blurring of the image and dust do not occur and imaging resolution (reproducibility) suffers less degradation in the fixing step. Also because it is not necessary to heat the toner with a heat source, the idle time, before printing can be started, after turning on the power to preheat the heating medium (fixing roller or the like) to a predetermined temperature is eliminated, so that printing can be started upon turning on the power. Eliminating the need for a high temperature heat source has another advantage that the temperature in the apparatus does not rise too high. It also eliminates such a danger that the recording paper catches fire due to the heat generated by the heat source, even when the recording paper jams in the fixing device due to a system breakdown or other trouble. There is also an advantage that fixing performance is less affected by the type of material and thickness of the recording medium such as glued paper, preprint paper and sheets of paper having different thicknesses.

Describing in more detail, the process of fixing a toner onto a recording paper in the photofixing method is as follows.

In the transfer step, a toner image is transferred onto a recording paper from a photosensitive drum. At this point of time, the toner is deposited on the recording paper in the form of a powder image to form a image and is in the state where the image can be damaged when rubbed with fingers. Then, the toner powder image on the recording paper is irradiated with flashlight from a Xenon flashlight. As a result of absorption of a light energy of flashlight, the toner is heated, softened and deposited on the recording paper. When the temperature is reduced after irradiation with flashlight, the toner image is solidified, thereby to complete a fixed toner image.

It is important to prevent so-called poor fixation wherein folding and rubbing of the recording paper cause peeling of the fixed toner image from the recording paper, resulting in poor image quality. For this purpose, it is necessary to design that melting of the toner during fixation is accelerated by enhancing the light adsorption capability of the toner, and thus the toner sufficiently penetrates into the paper and is firmly fixed.

The Xenon flash lamp commonly used in the photofixing method has an emission distribution in a wide range from an ultraviolet region to an infrared region, and shows a particularly strong emission intensity in the near infrared region of wavelengths ranging from 800 to 1000 nm. Therefore, it is required to establish the technology of efficiently absorbing a light energy in this region in order to develop a toner having high fixability. Recently, the demand for color prints has particularly been increased. The colorant used in the color toner has an absorption in the visible region, but has low light absorption efficiency in the near infrared region. Therefore, it is required to put a color toner capable of affording good fixability in the photofixing system into practical use.

In a black toner, a black coloring material as the colorant also absorbs light in the near infrared region. Therefore, the black toner has already been put into practical use as an electrophotographic apparatus employing a photofixing system. However, a further improvement in absorption efficiency is required to cope with recent increase of the demand for energy saving.

In response to the demand, it has been proposed to improve the fixability by adding an infrared absorbing agent to the color toner, and many patent applications related to this technology have been publicly disclosed such as: Japanese Unexamined Patent Publication (Kokai) Nos. 60-63545, 60-63546, 60-57858, 60-57857, 58-102248, 58-102247, 60-131544, 60-133460, 61-132959, W099/13382, 2000-147824, 7-191492, 2000-155439, 6-348056, 10-39535, 2000-35689, 11-38666, 11-125930, 11-125928, 11-125929, and 11-65167. Technologies disclosed in these publications are attempts to make color rendering and photofixability compatible with each other by adding an infrared absorbing agent to the toner. However, all of the infrared absorbing agents proposed has the problem of inability to achieve satisfactory fixation. To satisfy the photofixability, a large amount of these infrared absorbing agents must be added in the color toner. It is not always possible to meet the demand because of these problems such as (i) adverse influence on the chargeability of the toner, (ii) adverse influence on the color hue of the toner and (iii) increase in cost of the toner.

Japanese Unexamined Patent Publication (Kokai) Nos. 11-24319, 9-328412, 11-24317, 7-90310 and 6-228604 have proposed that the surface of fine particles is provided with a multi-layer film by adding additives in the form of fine particles in place of the use of the infrared absorbing agents described above, thereby controlling an absorption wavelength of light. However, none of these publications suggest that an absorption wavelength of fine particles is controlled in the near infrared region according to an emission wavelength of a photofixing device, thereby improving the fixability of the photofixed toner.

SUMMARY OF THE INVENTION

An object of the present invention is to provide a color toner, for forming an image, which allows use of the photofixing system for fixing images and is superior in fixability of the color toner, and which can also achieve a long life due to charge stabilization and environmental stabilization.

Another object of the present invention is to provide a color toner, for forming an image, which allows use of the photofixing system for fixing images without forming voids and is superior in fixability of the color toner, and also which can maintain a stable charge and developing properties for a long period because of less variation in charge amount due to an infrared absorbing agent used, and causes less influence on color hue due to the infrared absorbing agent.

Further, another object of the present invention is to provide a color image forming method, which allows use of the photofixing system for fixing images and is superior in fixability of the color toner, and which can also achieve a long life due to charge stabilization and environmental stabilization.

Furthermore, another object of the present invention is to provide a color image forming apparatus, which allows use of the photofixing system for fixing images and is superior in fixability of the color toner, and which can also achieve a long life due to charge stabilization and environmental stabilization.

The objects described above and other objects of the present invention will become apparent from the following detailed description.

In one aspect thereof, the present invention resides in a color toner for forming an image, comprising at least a binder resin and a colorant, which is used in an image forming method employing a photofixing system, said color toner further comprising at least one additive selected from the group consisting of:

(1) light-absorbing fine composite particles comprising core particles and at least two coating layers having different refractive indexes laminated on the surface of the core particles;

(2) an azulene compound represented by the following general formula (I):

(I)

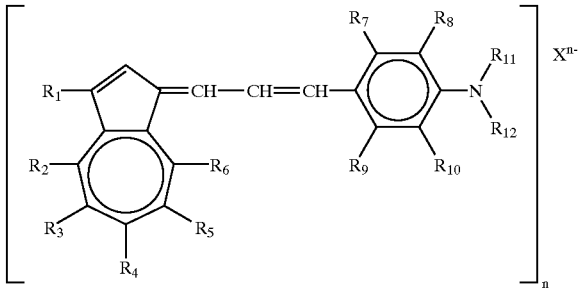

wherein $R_1$ to $R_{12}$ may be the same or different and each represents a hydrogen atom, or a substituted, or unsubstituted, saturated or unsaturated aliphatic hydrocarbon group, X represents an anion, and n represents a positive integer;

(3) a cyanine compound represented by the following general formula (II):

(II)

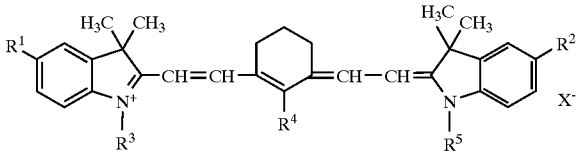

wherein $R^1$ to $R^5$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(4) a quinoline compound represented by the following general formula (III):

(III)

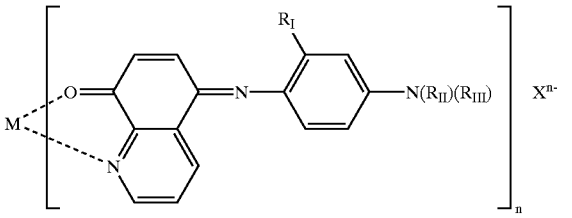

wherein $R_I$ represents a hydrogen atom, a halogen atom, or a monovalent substituent, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(5) a quinoline compound represented by the following general formula (IV):

(IV)

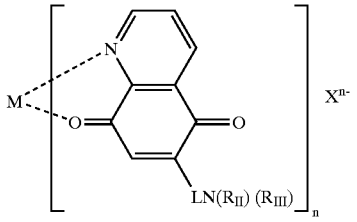

wherein L represents a bonding group, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(6) a polymethine compound represented by the following general formula (V):

(V)

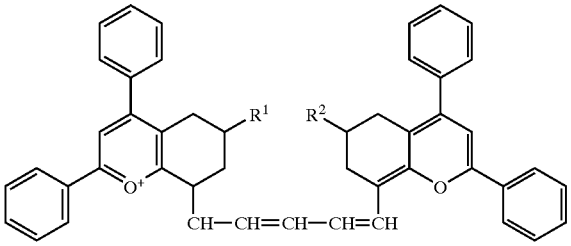

wherein $R^1$ and $R^2$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(7) a benzene metal complex represented by the following general formula (VI):

(VI)

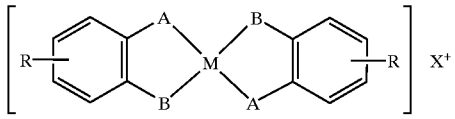

wherein R represents a monovalent substituent, A and B may be the same or different and each represents a sulfur atom, a selenium atom, or —NH, M represents a transition metal atom, and X represents a cation; and (8) photothermal, i.e., light-heat conversion, ceramics.

In another aspect thereof, the present invention resides in a method of forming a color image on a recording medium by means of an electrophotographic system which comprises the steps of forming an electrostatic latent image by image exposure, visualizing the electrostatic latent image by development, transferring the visualized image onto the recording medium and fixing the transferred image, wherein a developing agent containing the color toner of the present invention is used in the step of developing the electrostatic latent image, and photofixation is conducted at a light emission energy density ranging from 1.0 to 6.0 J/cm$^2$ in the step of fixing the transferred image after transferring the image visualized by using the developing agent onto the recording medium.

Further, in another aspect thereof, the present invention resides in an apparatus for forming a color image on a recording medium by means of an electrophotographic system, comprising an image exposing device for forming an electrostatic latent image, a developing device for visualizing the electrostatic latent image, an image transferring device for transferring the visualized image onto the recording medium, and an image fixing device for fixing the transferred image onto the recording medium, wherein the developing device is loaded with a developing agent containing the color toner of the present invention, and the image fixing device is provided with a photofixing device having a light emission energy density ranging from 1.0 to 6.0 J/cm$^2$.

DESCRIPTION OF THE PREFERRED EMBODIMENTS

Figure 1:
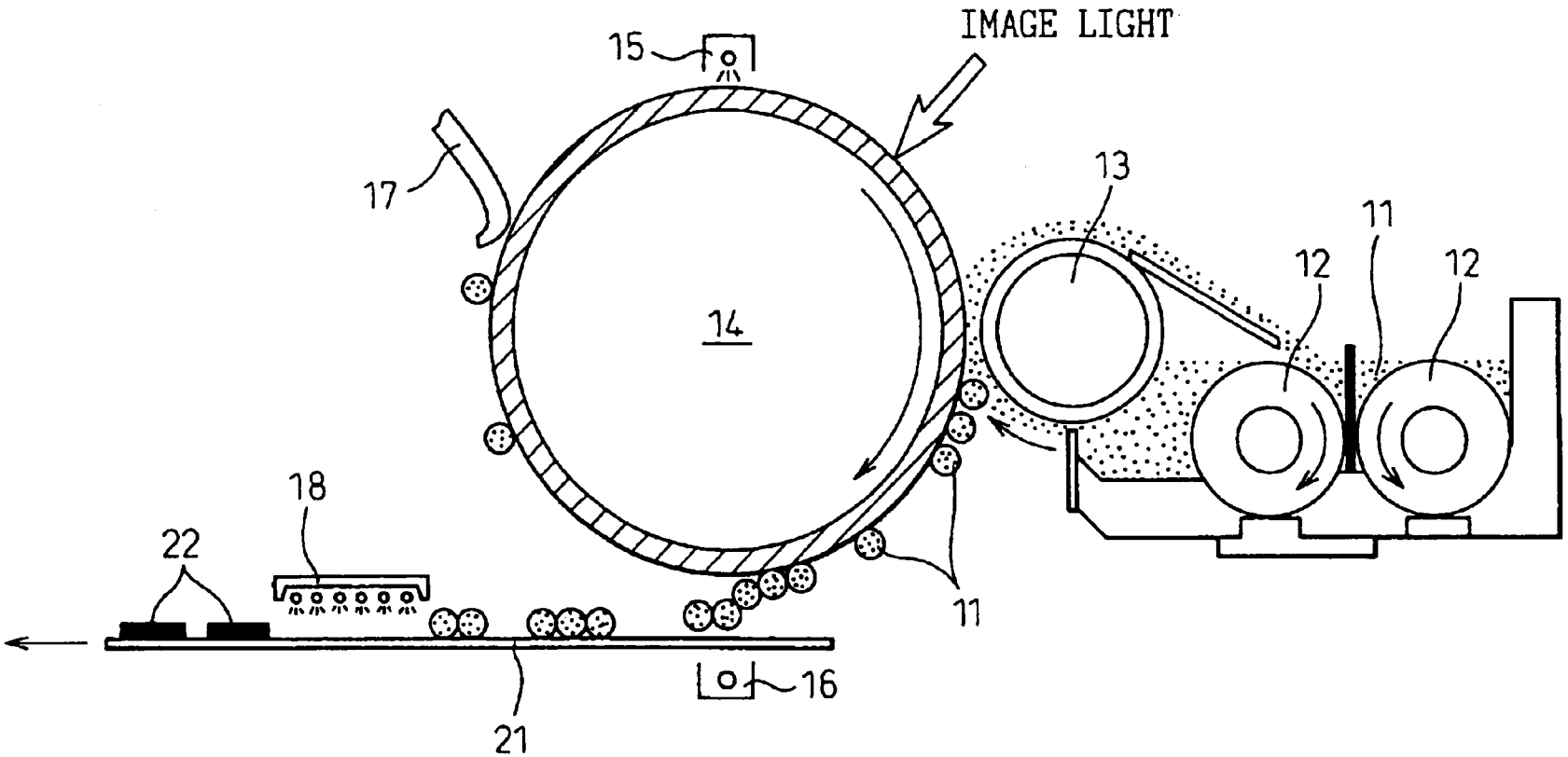
FIG. 1 is a sectional view schematically showing a preferred embodiment of an electrophotographic system for carrying out the image forming method employing a flash fixing system.

Generally, the color toner of the present invention can be advantageously used as a developing agent in either of the image forming method and the image forming apparatus that employ the photofixing system. Typically, the color toner of the present invention can also be used in various image forming methods and apparatuses, employing various image forming systems such as electrography, electrophotography and ionography such as, for example, electrophotographic copying machine, electrophotographic facsimile, electrophotographic printer and electrostatic printing machine. The present invention will now be described with reference to an electrophotographic process capable of working the present invention most advantageously. It will be appreciated that the present invention is not limited only to a specific electrophotographic process described below. It is also appreciated that the term "color toner" used herein also includes a black toner.

According to the electrophotographic process as described above, the surface of a photoconductive insulator such as a photosensitive drum is charged uniformly with a positive or a negative electrostatic charge, and then the photoconductive insulator is irradiated with image light, thereby to form an electrostatic latent image. Then, a developing agent made of a toner is caused to deposit on the latent image portion on the photoconductive insulator, thereby to visualize the latent image. The resulting toner image is electrostatically transferred onto a recording medium such as recording paper and then fixed. In the present invention, as described in detail below, a method of melting a toner by irradiation with light energy and solidifying and fixing the toner, that is, a photofixing method (also referred to as a flash fixing method) is employed.

In one aspect, the present invention resides in a color toner used as the developing agent in the developing step of such an electrophotographic process or the other image forming process.

There is no limitation to the developing method used in the practice of the present invention, and a proper developing method can be freely selected and employed for each application. In other words, according to the present invention, a developing agent most suitable for the developing method to be employed can be prepared and used for the particular application, while satisfying the requirements for the color toner of the present invention. Developing methods which can be employed in the present invention include both two-component developing system and one-component developing system that are widely used in the art.

In the two-component developing system, toner particles and carrier particles, such that comprise magnetite, ferrite, iron powder, glass beads or such particles coated with a resin, are brought into contact with each other, with the toner being caused to deposit on the carrier particles by the use of friction charging, and the toner is directed to a portion of latent image thereby to develop the image. In this system, a developing agent is constituted by combining the toner and the carrier. The particle diameter of the carrier is typically within a range from 30 to 500 $\mu$m, while 0.5 to 10% by weight of the toner particles is mixed with the carrier particles. Methods employed in this system include a magnetic brush development method.

The one-component developing system is also well known which is a modification of the two-component developing system wherein the carrier is not used. This method eliminates the need for mechanisms such as for toner concentration control, mixing and stirring because the carrier is not used, and also makes it possible to reduce the apparatus in size. In the one-component developing system, a thin uniform film of toner is formed on a developing roller which is made of a metal and an image is developed by attracting the toner to a portion of latent image. The toner particles deposited on the developing roller can be electrostatically charged by friction charging or electrostatic induction. In the case of one-component developing system employing friction charging, for example, a magnetic toner is used in BMT system and FEED system which involve contact, and a nonmagnetic toner is used in touchdown system which involves contact. Details of the electrophotographic processes and the developing methods employed therein will be left to many publications dealing with the subject of the electrophotographic system.

The color toner for forming an image of the present invention may have a composition similar to that of the color toner used in the electrophotographic system of the prior art. That is, the color toner of the present invention may be generally constituted so as to include at least a binder resin and a colorant. While various developing methods are employed in the electrophotographic system as described above, the color toner of the present invention may be either a magnetic toner which has magnetism by itself or a nonmagnetic toner depending on the developing method employed in the intended electrophotographic processes.

In the color toner of the present invention, the binder resin used as the base material is not specifically limited, but is preferably a thermoplastic resin made of a natural or synthetic polymer substance. The thermoplastic resin suited for use as the binder resin can have different molecular weights according to the desired effect. The molecular weight (weight-average molecular weight) of the binder resin is usually within a range from about 1,000 to 100,000, and preferably from about 5,000 to 50,000. The binder resin has a softening point of about 90 to 140° C. and a glass transition temperature of about 55 to 70° C.

Preferred examples of the binder resin include epoxy resin, polyamide resin, polyester resin, styrene-acrylic resin, styrene resin, acrylic resin, polyetherpolyol resin, phenol resin, silicone resin, polyvinyl resin, and polybutadiene resin. These binder resins may be used alone, or two or more resins may be used in combination or used in the form of a composite. A linear polyester resin and a polyester resin containing a crosslinking component may be used in combination.

A particularly preferable binder resin in the practice of the present invention is a polyester resin in view of low odor generated during fixation. Describing the polyester resin in more detail, the acid component used in the synthesis of the polyester resin includes, for example, terephthalic acid, isophthalic acid, ortho-phthalic acid, and an anhydride thereof. Terephthalic acid and isophthalic acid are preferred as the acid component. These acid components may be used alone or in combination. Other components can be used in combination with the compounds described above as far as odor does not become a problem during the flash fixation. Examples of the other acid component include maleic acid, fumaric acid, citraconic acid, itaconic acid, glutaconic acid, cyclohexanedicarboxylic acid, succinic acid, adipic acid, sebacic acid, azelaic acid, malonic acid. The acid component further includes, for example, alkyl- or alkenylsuccinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecenylsuccinic acid, or isododecenylsuccinic acid, or an anhydride or a lower alkyl ester of these acids, or the other dihydric carboxylic acid. To crosslink the polyester resin, a tri- or polyhydric carboxylic acid can be used as the other acid component. Examples of the tri- or polyhydric carboxylic acid include 1,2,4-benzenetricarboxylic acid, 1,3,5-benzenetricarboxylic acid, other polycarboxylic acid, and an anhydride thereof.

In the polyester resin, preferably 80 mol % or more, more preferably 90 mol % or more, and most preferably 95 mol % of an alcohol component is made of the alkylene oxide adduct of bisphenol A. When the amount of the alkylene oxide adduct of bisphenol A is less than 80 mol %, the amount of the monomer, which relatively causes odor, increases and, therefore, it is not preferred. The alkylene oxide adduct of bisphenol A includes, for example, a compound represented by the following formula:

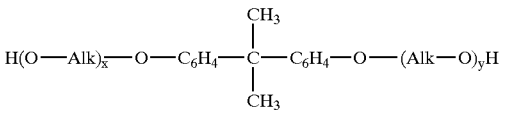

wherein Alk may be the same or different and each represents an alkylene group such as ethylene group or propylene group, and x and y each represents an integer of 1 or more. Examples of the compound include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane. These compounds may be used alone or in combination.

Among these compounds, polyoxypropylene(2.2)-2,2-bis(4-hydroxyphenyl)propane, polyoxyethylene(2.2)-2,2-bis(4-hydroxyphenyl)propane, and polyoxyethylene(2.0)-2,2-bis(4-hydroxyphenyl)propane are particularly preferable.

In the polyester resin used as the binder resin in the present invention, other alcohol components may be used in combination with the alcohol components described above, if necessary. Examples the other alcohol component include other dihydric alcohols, for example, diols (e.g. ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol), and bisphenol A and hydrogenated bisophenol A.

As the other alcohol component, a tri- or polyhydric alcohol component is also preferable. Examples of the tri- or polyhydric alcohol component include tri- or polyhydric alcohols, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

In addition, esterification catalysts commonly used to promote the reaction in the synthesis of the polyester resin, for example, zinc oxide, stannous oxide, dibutyltin oxide, and dibutylthin dilaurate can be used.

In the color toner of the present invention, the colorant to be dispersed in the binder resin includes various well-known dyes and pigments and can be optionally selected and used. Preferred examples of the colorant include, but are not limited to, carbon black, lamp black, iron black, ultramarine blue, nigrosin dye, ferrite, magnetite (for black toner), aniline blue, chalco oil blue, ultramarine blue, DuPont oil red, anthraquinone, quinoline yellow, methylene blue cloride, phthalocyanine blue, phthalocyanine green, anilide compound, benzimidazolone, hansa yellow, rhodamine 6C lake, chrome yellow, quinacridon, benzidine yellow, malachite green, malachite green hexanoate, oil black, azo oil black, rose bengal, monoazo pigment, disazo pigment, and trisazo pigment (for color toner). These colorants may be used alone, or used in combination to obtain a desired toner color.

The content of the colorant in the toner can vary according to the desired results, but is usually within a range from 0.1 to 20 parts by weight, and preferably from 0.5 to 10 parts by weight, based on 100 parts by weight of the toner in view of the coloring force of printing, shape retention of the toner and scattering of the toner, in order to obtain the best toner characteristics.

In the electrophotographic color toner of the present invention, as described above, it is essential to incorporate at least one specific compound selected from the group consisting of the compounds (1) to (8) described above, in addition to the binder resin and the colorant. The compound used as the additive basically has an infrared absorbing function, and therefore it can also be referred to as an infrared absorbing compound. As a matter of course, these infrared absorbing agents may be used alone or, two or more infrared absorbing agents may be used in combination. The respective infrared absorbing agents will be described below.

(1) Light-absorbing fine composite particles comprising core particles and at least two coating layers having different refractive indexes laminated on the surface of the core particles The light-absorbing fine composite particles have a light absorption peak at a wavelength ranging from 750 to 1200 nm, and therefore the light absorbing fine composite particles are treated as one form of the "infrared absorbing compound". The present inventors have found that, when an infrared absorbing compound in the form of fine composite particles is added in the color toner, not only the fixability of the color toner in photofixation can be remarkably improved as compared with the case of a conventional infrared absorbing agent, but also the color toner can be improved so as to achieve stable charge and developing properties for a long period because of strong resistance to environmental change.

In the light-absorbing fine composite particles of the present invention, core particles can be made of various materials. Examples of the material suited for use in the core particles include, but are not limited to, iron powders, ferrite powders, suspended resin particles or glass beads. In case the composite microparticles are added to the toner to be kneaded and ground, iron powders or glass beads are preferably used as the core particles. Since heat is applied when the toner is kneaded, core particles are preferably made of the material that is less likely to be deformed.

The core particles having different particle diameters can be used. The particle diameter of the core particles is preferably within a range from 0.01 to 5 $\mu$m, and more preferably from 0.1 to 2 $\mu$m. When the particle diameter of the core particles is smaller than 0.01 $\mu$m, good coating can not be formed because of agglomeration. On the other hand, when the particle diameter of the core particles is larger than 5 $\mu$m, the core particles can not be added to the commonly used toner having a particle diameter of 5 to 20 $\mu$m.

On the surface of the light absorbing fine composite particles, at least two coating layers having different refractive indexes are laminated. In the present invention, it is possible to make the light absorbing fine composite particles efficiently absorb near infrared light by laminating a plurality of metal oxide films or metal films on the surface of the fine composite particles. Fresnel's interference principle can be applied to the principle of near infrared absorption. That is, it is possible to reflect light having a fixed wavelength in accordance with Fresnel's interference principle by forming a plurality of films. Only light having a specific wavelength can be selectively absorbed by plural coating layers are laminated according to the present invention. Since the calculation actually deviates from the principle and fine particles generally have unevenness, the near infrared spectrum must be evaluated while controlling the film thickness by trial and error. Consequently, it is made possible to obtain fine complex particles which is scarcely colored and has an absorption peak at a wavelength ranging from 750 to 1200 nm.

In the infrared absorbing fine composite particles of the present invention, various materials can be used to form a coating layer. Examples of a proper material for forming a coating layer include, but are not limited to, various inorganic materials or metals and oxides thereof, for example, an oxide of iron, nickel, chromium, titanium, aluminum, silicon, calcium, magnesium, barium or zinc, or a composite oxide thereof in the light absorbing fine composite particles. A combination of titanium oxide and silicon oxide is most preferable because of good production stability due to good ease of coating and high heat resistance.

The coating layer, with which the core particles are surrounded, usually has a multi-layer (two- or three-layer) structure. The film thickness of the coating layer can be optionally set, independently, but is preferably set in consideration of each film thickness. The film thickness of the coating layer can be usually controlled within a range from 10 to 1000 nm, but is preferably within a range from 50 to 500 nm so as to retain the properties, such as magnetic force, of the core particles.

The infrared absorbing fine composite particles of the present invention can be used in various forms in the color toner. In other words, the fine composite particles are effective even when added externally or internally to the toner matrix. The amount of the fine composite particles varies widely. In the case of internal addition, the amount is usually within a range from 0.1 to 40 parts by weight, and preferably from 0.5 to 10 parts by weight, based on 100 parts by weight of the toner. In the case of external addition, the amount is usually within a range from 0.01 to 10 parts by weight, and preferably from 0.1 to 5 parts by weight, based on 100 parts by weight of the toner. In the case of the internal addition, the fixability is lowered even when the amount of the fine composite particles is less than 0.1 parts by weight or more than 40 parts by weight. Similarly, in the case of the external addition, the fixability is lowered even when the amount of the fine composite particles is less than 0.01 parts by weight or more than 10 parts by weight. The reason why the fixability is lowered by adding a large amount of the fine composite particles is as follows. Since the fine composite particles only serve as a heat source when exposed to light and the fine composite particles themselves are not fixed, an optimum addition amount exists. These fine composite particles may be used alone, or two or more fine composite particles may be used in combination.

Conventional inorganic or organic infrared absorbing agents may be preferably added additionally to the color toner of the present invention to improve the fixability. The additionally used infrared absorbing agent is preferably an infrared absorbing compound which shows a light absorption peak at a wavelength ranging from 750 to 1200 nm, though it varies with the wavelength of a light source used in photofixation. Examples of the inorganic infrared absorbing agent include, but are not limited to, metal oxides such as ytterbium oxide, ytterbium phosphate, indium oxide, tin oxide, and zinc oxide. Examples of the organic infrared absorbing agent include, but are not limited to, organic compounds such as aminium salt, diimonium salt, cadmium stannate, melocyanine pigment, naphthalocyanine pigment, phthalocyanine pigment, cyanine pigment, polymethine pigment, specific amide compound, and thiol-nickel complex. These commonly used infrared absorbing agents may be used in combination, if necessary.

In the practice of the present invention using these infrared absorbing fine composite particles, which is described in detail hereinafter, a halogen exposing device or flashlight exposing device, which has a light emission peak in the infrared region at a wavelength ranging from 750 to 1200 nm, can be advantageously used as an image fixing device for fixing a toner powder image on a recording medium such as recording paper.

(2) Azulene compound represented by the formula (I)

The present inventors have found the following facts. That is, an azulene compound represented by the formula (I) (also referred to as an azulene dye) has a very small light absorptivity in the visible region and has an absorption in the infrared region at about 800 nm, and therefore a color toner containing this compound can efficiently absorb a light energy in the near infrared region of large emission intensity of various flash lamps, including a Xenon flash lamp, even when containing no black pigment. Accordingly, light absorption in the near infrared region is improved as compared with a color toner which does not contain this compound and good fixability can be obtained from less flash light energy, and thus it is effective to reduce a fixation energy.

An azulene dye often has a reddish purple color tone and a red or blue toner is preferably applied in consideration of application to the color toner. However, since a hiding power of the azulene dye is not so large, the toner other than the red or blue toner can also be applied by optimizing the addition amount.

In the formula (I), by which the azulene compound used for the purpose of infrared absorption in the present invention is represented, $R_1$ to $R_{12}$ may be the same or different and each represents a hydrogen atom, or a substituted or unsubstituted, saturated or unsaturated, aliphatic hydrocarbon group, for example, an alkyl group. Proper alkyl group is an alkyl group having 1 to 8 carbon atoms. Examples thereof include methyl group, ethyl group, n-propyl group, isopropyl group, n-butyl group, n-pentyl group, n-hexyl group, n-octyl group, and 2-ethylhexyl group.

X in the formula is an anion and examples thereof include perchloric acid ion ($ClO_4^-$), fluoboric acid ion ($BF_4^-$), trichloroacetic acid ion ($CCl_3COO^-$), trifluoroacetic acid ion ($CF_3COO^-$), picric acid ion ($(NO_2)_3C_6H_2O^-$), hexafluoroarsenic acid ion ($AsF_6^-$), hexafluoroantimonic acid ion ($SbF_6^-$), benzenesulfonic acid ion ($C_6H_5SO_3^-$), ethanesulfonic acid ion ($C_2H_5SO_3^-$), phosphoric acid ion ($PO_4^{2-}$), sulfuric acid ion ($SO_4^{2-}$), and chlorine ion ($Cl^-$).

n is a positive integer of 1 or more.

The azulene compound described above can be internally added to the color toner. The amount of the azulene compound can vary widely, but is usually within a range from 0.5 to 5.0 parts by weight, and preferably from 0.7 to 2.0 parts by weight, based on 100 parts by weight of the toner. When the amount of the azulene compound is less than 0.5 parts by weight, light energy absorptivity in the near infrared region of the toner is likely to be lowered to cause poor fixability. On the other hand, when the amount of the azulene compound is more than 5.0 parts by weight, the fixability is good, but defects such as poor charge and change in color hue are likely to occur. These azulene compounds may be used alone, or two or more azulene compounds may be used in combination.

To improve the fixability, conventional inorganic or organic infrared absorbing agents may be added additionally to the color toner of the present invention. Examples of the inorganic or organic infrared absorbing agents are as described above.

As described previously, in the practice of the present invention using these infrared absorbing azulene compounds, a halogen exposing device or a flashlight exposing device, which has a light emission peak in the infrared region at a wavelength ranging from 750 to 1200 nm, can be advantageously used as an image fixing device for fixing a toner powder image on a recording medium such as recording paper.

(3) Cyanine compound represented by the formula (II)

The present inventors have found the following facts. That is, a cyanine compound represented by the formula (II) (also referred to as a cyanine dye) has a very small light absorptivity in the visible region and has an absorption in the infrared region at about 750 nm or more, and therefore a color toner containing this compound can efficiently absorb a light energy in the near infrared region of large emission intensity of various flash lamps, including a Xenon flash lamp, even when containing no black pigment. Accordingly, light absorption in the near infrared region is improved as compared with a color toner which does not contain this compound and good fixability can be obtained by less flash light energy, and thus it is effective to reduce a fixation energy. It has also been found that this cyanine compound achieves stable charge and developing properties for a long period because of strong resistance to environmental change.

In the formula (II), by which the cyanine compound used for the purpose of infrared absorption in the present invention is represented, $R^1$ to $R^5$ may be the same or different and each represents a hydrogen atom, a substituted or unsubstituted, saturated or unsaturated, aliphatic hydrocarbon group, for example, a methyl group, an ethyl group, an n-propyl group, an isopropyl group, an n-butyl group, an n-pentyl group, an n-hexyl group, an n-octyl group, a 2-ethylhexyl group, a vinyl group, an allyl group, a propenyl group, or an isopropenyl group; an alicyclic hydrocarbon group, for example, a cyclohexyl group; an aromatic hydrocarbon group, for example, a phenyl group or a naphthyl group; or an aromatic hydrocarbon group having an aliphatic hydrocarbon side chain, for example, a tolyl group, a xylyl group, a cumenyl group, a mesityl group, a benzyl group, a phenethyl group, or a styryl group.

X in the formula is an anion and examples thereof include perchloric acid ion ($ClO_4^-$), fluoboric acid ion ($BF_4^-$), trichloroacetic acid ion ($CCl_3COO^-$), trifluoroacetic acid ion ($CF_3COO^-$), picric acid ion ($(NO_2)_3C_6H_2O^-$), hexafluoroarsenic acid ion ($AsF_6^-$), hexafluoroantimonic acid ion ($SbF_6^-$), benzenesulfonic acid ion ($C_6H_5SO_3^-$), ethanesulfonic acid ion ($C_2H_5SO_3^-$), phosphoric acid ion ($PO_4^{2-}$), sulfuric acid ion ($SO_4^{2-}$), chlorine ion ($Cl^-$), toluenesulfonic acid, and nitric acid.

The cyanine compound described above can be internally added to the color toner. The amount of the cyanine compound can vary widely, but is usually within a range from 0.1 to 20.0 parts by weight, and preferably from 0.5 to 3 parts by weight, based on 100 parts by weight of the toner. When the amount of the cyanine compound is less than 0.1 parts by weight, light energy absorptivity in the near infrared region of the toner is likely to be lowered, thereby to lower the fixability. On the other hand, when the amount of the cyanine compound is more than 20.0 parts by weight, the fixability is good, but the charge amount is lowered to cause fog. These cyanine compounds may be used alone, or two or more cyanine compounds may be used in combination.

To improve the fixability, conventional inorganic or organic infrared absorbing agents may be added additionally to the color toner of the present invention. Examples of the inorganic or organic infrared absorbing agents are as described above.

As described previously, in the practice of the present invention using these infrared absorbing cyanine compounds, a halogen exposing device or a flashlight exposing device, which has a light emission peak in the infrared region at a wavelength ranging from 750 to 1200 nm, can be advantageously used as an image fixing device for fixing a toner powder image on a recording medium such as recording paper.

(4) Quinoline compound represented by the formula (III)

The present inventors have found the following facts. That is, a quinoline compound represented by the formula (III) (also referred to as a quinoline dye) has a very small light absorptivity in the visible region and has an absorption in the region ranging from 750 to 800 nm and 1200 nm, and therefore a color toner containing this quinoline compound can efficiently absorb a light energy in the near infrared region of large emission intensity of various flash lamps, including a Xenon flash lamp, even when containing no black pigment. The following facts have also been found. That is, since the quinoline compound is less likely to change the color hue of the toner colored with the colorant, a practical flash-fixed color toner can be obtained. Light absorption in the near infrared region is improved in the black toner as compared with a color toner which does not contain this compound and good fixability can be obtained by less flash light energy, and thus it is effective to reduce a fixation energy.

In the formula (III), by which the quinoline compound used for the purpose of infrared absorption in the present invention is represented, $R_I$ represents a hydrogen atom, a halogen atom, for example, a fluorine atom, a chlorine atom, a bromine atom, or a iodine atom, or a monovalent substituent, for example, a substituted or unsubstituted, hydrocarbon group such as methyl group or ethyl group. If necessary, the substituent $R_I$ may be bonded with the benzene ring at the other position.

$R_{II}$ and $R_{III}$ in the formula may be the same or different and each represents a hydrogen atom, or a substituted or unsubstituted, saturated or unsaturated, aliphatic hydrocarbon group, for example, an alkyl group. Examples of proper alkyl group include alkyl groups having 1 to 18 carbon atoms, for example, methyl group, ethyl group, n-propyl group, isopropyl group, n-butyl group, n-pentyl group, n-hexyl group, n-octyl group, and 2-ethylhexyl group. If necessary, the substituent $—N(R_{II})(R_{III})$ may be bonded with the benzene ring at the other position, or may be bonded with the benzene ring through an arbitrary bonding group, for example, an aliphatic or aromatic hydrocarbon group.

M in the formula represents a transition metal atom, for example, Cu, Ni, Co, Cr, Zn, Mn, Fe, Pt, or Pb.

X in the formula is an anion and examples thereof include perchloric acid ion ($ClO_4^-$), fluoboric acid ion ($BF_4^-$), trichloroacetic acid ion ($CCl_3COO^-$), trifluoroacetic acid ion ($CF_3COO^-$), picric acid ion ($(NO_2)_3C_6H_2O^-$), hexafluoroarsenic acid ion ($AsF_6^-$), hexafluoroantimonic acid ion ($SbF_6^-$), benzenesulfonic acid ion ($C_6H_5SO_3^-$), ethanesulfonic acid ion ($C_2H_5SO_3^-$), chlorine ion ($Cl^-$), or divalent phosphoric acid ion ($PO_4^{2-}$) or sulfuric acid ion ($SO_4^{2-}$).

n in the formula is an integer of 1 or more.

These quinoline compounds may be used alone, or two or more quinoline compounds may be used in combination.

The quinoline compound described above can be internally added to the color toner. The amount of the quinoline compound can vary widely, but is usually within a range from 0.1 to 20.0 parts by weight, and preferably from 0.5 to 5 parts by weight, based on 100 parts by weight of the toner. When the amount of the quinoline compound is less than 0.1 parts by weight, light energy absorptivity in the near infrared region of the toner is likely to be lowered to cause poor fixability. On the other hand, when the amount of the quinoline compound is more than 20.0 parts by weight, the fixability is good, but defects such as poor charge and change in color hue occur. These quinoline compounds may be used alone, or two or more quinoline compounds may be used in combination.

To improve the fixability, conventional inorganic or organic infrared absorbing agents may be added additionally to the color toner of the present invention. Examples of the inorganic or organic infrared absorbing agents are as described above.

As described previously, in the practice of the present invention using these infrared absorbing quinoline compounds, a halogen exposing device or flashlight exposing device, which has a light emission peak in the infrared region at a wavelength ranging from 750 to 1200 nm, can be advantageously used as an image fixing device for fixing a toner powder image on a recording medium such as recording paper.

(5) Quinoline compound represented by the formula (IV)

The present inventors have found the following facts. That is, a quinoline compound represented by the formula (IV) (also referred to as a quinoline dye) has a very small light absorptivity in the visible region and has an absorption in the region ranging from 750 to 800 nm and 1200 nm, and therefore a color toner containing this quinoline compound can efficiently absorb a light energy in the near infrared region of large emission intensity of various flash lamps including Xenon flash lamp even when containing no black pigment. The following facts have also been found. That is, since the quinoline compound is less likely to change the color hue of the toner colored with the colorant, a practical flash-fixed color toner can be obtained. Light absorption in the near infrared region is improved in the black toner as compared with a color toner which does not contain this compound and good fixability can be obtained by less flash light energy, and thus it is effective to reduce a fixation energy.

In the formula (IV), by which the quinoline compound used for the purpose of infrared absorption in the present invention is represented, L represents a bonding group, for example, an aliphatic or aromatic hydrocarbon group such as methyl group, ethyl group, butyl group, phenyl group, or tolyl group.

$R_{II}$ and $R_{III}$ in the formula may be the same or different and each represents a hydrogen atom, or a substituted or unsubstituted, saturated or unsaturated, aliphatic hydrocarbon group, for example, an alkyl group. Examples of proper alkyl group include alkyl groups having 1 to 18 carbon atoms, for example, methyl group, ethyl group, n-propyl group, isopropyl group, n-butyl group, n-pentyl group, n-hexyl group, n-octyl group, and 2-ethylhexyl group.

Therefore, the substituent —$LN(R_{II})(R_{III})$ is preferably —$C_6H_4$—$NH(C_3H_7)$, $C_6H_4$—$N(CH_3)_2$, $C_6H_4$—$NH_2$, $C_6H_4$—$NH(CH_3)$, or $C_6H_4$—$N(C_2H_5)_2$. If necessary, the substituent —$LN(R_{II})(R_{III})$ may be bonded with the benzene ring at the other position.

M in the formula represents a transition metal atom, for example, Cu, Ni, Co, Cr, Zn, Mn, Fe, Pt, or Pb.

X in the formula is an anion and examples thereof include perchloric acid ion ($ClO_4^-$), fluoboric acid ion ($BF_4^-$), trichloroacetic acid ion ($CCl_3COO^-$), trifluoroacetic acid ion ($CF_3COO^-$), picric acid ion ($(NO_2)_3C_6H_2O^-$), hexafluoroarsenic acid ion ($AsF_6^-$), hexafluoroantimonic acid ion ($SbF_6^-$), benzenesulfonic acid ion ($C_6H_5SO_3^-$), ethanesulfonic acid ion ($C_2H_5SO_3^-$), chlorine ion ($Cl^-$), or divalent phosphoric acid ion ($PO_4^{2-}$) or sulfuric acid ion ($SO_4^{2-}$).

n in the formula is an integer of 1 or more.

These quinoline compounds may be used alone, or two or more quinoline compounds may be used in combination.

The quinoline compound described above can be internally added to the color toner. The amount of the quinoline compound can vary widely, but is usually within a range from 0.1 to 20.0 parts by weight, and preferably from 0.5 to 5 parts by weight, based on 100 parts by weight of the toner. When the amount of the quinoline compound is less than 0.1 parts by weight, light energy absorptivity in the near infrared region of the toner is likely to be lowered to cause poor fixability. On the other hand, when the amount of the quinoline compound is more than 20.0 parts by weight, the fixability is good, but defects such as poor charge and change in color hue occur. These quinoline compounds may be used alone, or two or more quinoline compounds may be used in combination.

To improve the fixability, conventional inorganic or organic infrared absorbing agents may be added additionally to the color toner of the present invention. Examples of the inorganic or organic infrared absorbing agents are as described above.

As described previously, in the practice of the present invention using these infrared absorbing quinoline compounds, a halogen exposing device or flashlight exposing device, which has a light emission peak in the infrared region at a wavelength ranging from 750 to 1200 nm, can be advantageously used as an image fixing device for fixing a toner powder image on a recording medium such as recording paper.

(6) Polymethine compound represented by the formula (V)

The present inventors have found the following facts. That is, a polymethine compound represented by the formula (V) has a very small light absorptivity in the visible region and has an absorption in the infrared region at about 750 nm or more, and therefore a color toner containing this compound can efficiently absorb a light energy in the near infrared region of emission intensity of various flash lamps, including a Xenon flash lamp, even when containing no black pigment. Accordingly, light absorption in the near infrared region is improved as compared with a color toner which does not contain this compound and good fixability can be obtained by less flash light energy, and thus it is effective to reduce a fixation energy. It has also been found that this polymethine compound achieves stable charge and developing properties for a long period because of strong resistance to environmental change.

In the formula (V), by which the polymethine compound used for the purpose of infrared absorption in the present invention is represented, $R^1$ and $R^2$ may be the same or different and each represents a hydrogen atom, a substituted or unsubstituted, saturated or unsaturated, aliphatic hydrocarbon group, for example, a methyl group, an ethyl group, an n-propyl group, an isopropyl group, an n-butyl group, an n-pentyl group, an n-hexyl group, an n-octyl group, a 2-ethylhexyl group, a vinyl group, an allyl group, a propenyl group, or an isopropenyl group; an alicyclic hydrocarbon group, for example, a cyclohexyl group; an aromatic hydrocarbon group, for example, a phenyl group or a naphthyl group; or an aromatic hydrocarbon group having an aliphatic hydrocarbon side chain, for example, a tolyl group, a xylyl group, a cumenyl group, a mesityl group, a benzyl group, a phenethyl group, or a styryl group.

X in the formula is an anion and examples thereof include perchloric acid ion ($ClO_4^-$), fluoboric acid ion ($BF_4^-$), fluophosphoric acid ($PF_6^-$), trichloroacetic acid ion ($CCl_3COO^-$), trifluoroacetic acid ion ($CF_3COO^-$), picric acid ion ($(NO_2)_3C_6H_2O^-$), hexafluoroarsenic acid ion ($AsF_6^-$), hexafluoroantimonic acid ion ($SbF_6^-$), benzenesulfonic acid ion ($C_6H_5SO_3^-$), ethanesulfonic acid ion ($C_2H_5SO_3^-$), phosphoric acid ion ($PO_4^{2-}$) sulfuric acid ion ($SO_4^{2-}$), chlorine ion ($Cl^-$), toluenesulfonic acid, and nitric acid.

The polymethine compound described above can be internally added to the color toner. The amount of the polymethine compound can vary widely, but is usually within a range from 0.1 to 20.0 parts by weight, and preferably from 0.5 to 3 parts by weight, based on 100 parts by weight of the toner. When the amount of the polymethine compound is less than 0.1 parts by weight, light energy absorptivity in the near infrared region of the toner is likely to be lowered, thereby to lower the fixability. On the other hand, when the amount of the polymethine compound is more than 20.0 parts by weight, the fixability is good, but the charge amount is lowered to cause fog. These polymethine compounds may be used alone, or two or more polymethine compounds may be used in combination.

To improve the fixability, conventional inorganic or organic infrared absorbing agents may be added additionally to the color toner of the present invention. Examples of the inorganic or organic infrared absorbing agents are as described above.

As described previously, in the practice of the present invention using these infrared absorbing polymethine compounds, a halogen exposing device or flashlight exposing device, which has a light emission peak in the infrared region at a wavelength ranging from 750 to 1200 nm, can be advantageously used as an image fixing device for fixing a toner powder image on a recording medium such as recording paper.

(7) Benzene metal complex represented by the formula (VI)

The present inventors have found the following facts. That is, a benzene metal complex represented by the formula (VI) has a very small light absorptivity in the visible region and has an absorption in the region ranging from 750 to 800 nm and 1200 nm, and therefore a color toner containing this benzene metal complex can efficiently absorb a light energy in the near infrared region of large emission intensity of various flash lamps including Xenon flash lamp even when containing no black pigment. The following facts have also been found. That is, as the benzene metal complex is less likely to change the color hue of the toner colored with the colorant, a practical flash-fixed color toner can be obtained. Light absorption in the near infrared region is improved in the black toner as compared with a color toner which does not contain this compound and good fixability can be obtained by less flash light energy, and thus it is effective to reduce a fixation energy.

In the formula (VI), by which the benzene metal complex used for the purpose of infrared absorption in the present invention is represented, R represents a monovalent substituent which can arbitrary exist and the bonding position can be arbitrary changeable. If necessary, two or more substituents R(s) may be bonded with one benzene ring. Examples of proper substituent R include saturated or unsaturated chain hydrocarbon group such as alkyl group or allyl group; alicyclic hydrocarbon group such as cyclohexyl group; aromatic hydrocarbon group such as benzyl group, phenyl group, alkenyl group, or alkynyl group; arylene hydrocarbon group (aliphatic-aromatic hydrocarbon group); and group wherein hydrogen atoms of these groups are subjected to halogenation substitution, alkyl etherification substitution, phenyl etherification substitution, N-alkylamino substitution or N-dialkylamino substitution.

A and B in the formula may be the same or different and each represents a sulfur atom, a selenium atom, or —NH.

M in the formula represents a transition metal atom, for example, Cu, Ni, Co, Cr, Zn, Mn, Fe, Pt, or Pb, and Ni is particularly useful.

X represents a cation, for example, a quaternary ammonium ion.

The benzene metal complex described above can be internally added to the color toner. The amount of the benzene metal complex can vary widely, but is usually within a range from 0.1 to 20.0 parts by weight, and preferably from 0.5 to 5 parts by weight, based on 100 parts by weight of the toner. When the amount of the benzene metal complex is less than 0.1 parts by weight, light energy absorptivity in the near infrared region of the toner is likely to be lowered to cause poor fixability. On the other hand, when the amount of the benzene metal complex is more than 20.0 parts by weight, the fixability is good, but defects such as poor charge and change in color hue occur. These benzene metal complexes may be used alone, or two or more benzene metal complex may be used in combination.

To improve the fixability, conventional inorganic or organic infrared absorbing agents may be added additionally to the color toner of the present invention. Examples of the inorganic or organic infrared absorbing agents are as described above.

As described previously, in the practice of the present invention using these infrared absorbing benzene metal complexes, a halogen exposing device or a flashlight exposing device, which has a light emission peak in the infrared region at a wavelength ranging from 750 to 1200 nm, can be advantageously used as an image fixing device for fixing a toner powder image on a recording medium such as recording paper.

(8) Photothermal (light-heat) conversion ceramics

The present inventors have found the following facts. That is, photothermal conversion ceramics as a kind of inorganic compounds are useful as the infrared absorbing compound, in addition to various infrared absorbing compounds described above. The photothermal conversion ceramics have a very small light absorptivity in the visible region and has an absorption at 750 nm or more, and therefore a color toner containing this inorganic compound can efficiently absorb a light energy in the near infrared region of emission intensity of a Xenon flash lamp even when containing no black pigment. The following facts have also been found. That is, since photothermal conversion ceramics are less likely to change the color hue of the toner colored with the colorant, a practical flash-fixed color toner can be obtained. Light absorption in the near infrared region is improved in the black toner as compared with a color toner which does not contain this compound and good fixability can be obtained by less flash light energy, and thus it is effective to reduce a fixation energy.

As the photothermal conversion ceramics used for the purpose of infrared absorption in the present invention, zirconium oxide is particularly useful. Japanese Unexamined Patent Publication (Kokai) No. 7-230185 discloses a method of producing an electrophotographic toner comprising toner particles and a fluidizing agent such as fine silica particles or zirconium carbide. Zirconium oxide used as the fluidizing agent in this publication is that which is externally added to the toner particles, thereby to uniformly deposit on the surface of the particles, thus preventing toner fog and unevenness in density. Therefore, zirconium oxide has no relation with a function as the infrared absorbing agent.

The photothermal conversion ceramics described above can be internally added to the color toner. The amount of the photothermal conversion ceramics can vary widely, but is usually within a range from 0.1 to 20.0 parts by weight, and preferably from 0.5 to 5 parts by weight, based on 100 parts by weight of the toner. When the amount of the photothermal conversion ceramics is less than 0.1 parts by weight, light energy absorptivity in the near infrared region of the toner is likely to be lowered to cause poor fixability. On the other hand, when the amount of the photothermal conversion ceramic is more than 20.0 parts by weight, the fixability is good, but defects such as poor charge and change in color hue occur. The photothermal conversion ceramic may be used alone, or two or more photothermal conversion ceramics may be used in combination.

To improve the fixability, conventional inorganic or organic infrared absorbing agents may be added additionally to the color toner of the present invention. Examples of the inorganic or organic infrared absorbing agents are as described above.

As described previously, in the practice of the present invention using the infrared absorbing photothermal conversion ceramic, a halogen exposing device or flashlight exposing device, which has a light emission peak in the infrared region at a wavelength ranging from 750 to 1200 nm, can be advantageously used as an image fixing device for fixing a toner powder image on a recording medium such as recording paper.

The image forming color toner of the present invention may optionally contain various additives, in addition to the essential components described above, such as a binder resin, a colorant and any of the infrared absorbing compounds (1) to (8) as well as an optional inorganic and/or organic infrared absorbing agents.

The color toner of the present invention can contain a charge control agent to control the chargeability of the toner. The charge control agent used in the present invention is not specifically limited as far as it has an ability to charge the toner. In consideration of the fact that the toner has a small influence on the color hue in the color toner, the charge control agent is colorless or has a light color. A quaternary ammonium salt (colorless), a nigrosin dye (black) and a triphenylmethane derivative (blue) can be preferably used as a positive charge control agent, while a naphtholic acid-zinc complex (colorless), a salicylic acid-zinc complex (colorless) and a boron compound can be preferably used as a negative color control agent. These charge control agents are generally used in the amount within a range from 0.05 to 10 parts by weight based on 100 parts by weight of the toner.

The color toner of the present invention may contain waxes for the purpose of enhancing the fixability of the toner. Examples of suitable waxes include polyolefins (for example, polyethylene and polypropylene), fatty acid esters, paraffin wax, carnauba wax, amide wax, and acid-modified wax. These waxes may be used alone, or two or more waxes may be used in combination. Among these waxes, waxes having a softening temperature of 150° C. or lower are preferable and those having a softening temperature lower than that melt softening temperature of the binder resin are particularly preferable.

The color toner of the present invention may further contain external additives. The color toner of the present invention may contain fine white inorganic powders for the purpose of improving the fluidity. Examples of proper fine inorganic powders include fine powders of silica, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these fine powders, fine silica powders are particularly preferred. The amount of these fine inorganic powders to be mixed with the toner is usually within a range from 0.01 to 5 parts by weight, and preferably from 0.01 to 2.0 parts by weight, based on 100 parts by weight of the toner. Publicly known materials such as silica, titanium, fine resin powders (for example, resin particles of polystyrene, PMMA, and melamine resin) and alumina can be used in combination. As the cleaning active agent, for example, fine powders of metal salts of higher fatty acid (for example, zinc stearate) and fluorine polymeric substances may be added.

The color toner of the present invention can be prepared according to various procedures using the toner components described above as the starting materials. For example, the color toner of the present invention can be prepared by using a well-known technique such as a mechanical grinding method of grinding a resin mass containing a dispersant therein and classifying the resulting resin particles, or a polymerization method of polymerizing a monomer while incorporating a colorant to prepare fine particles.

If the color toner of the present invention is prepared by the mechanical grinding method, toner components such as binder resin, colorant, infrared absorbing compound of the present invention, waxed and charge control agent are mixed and the resulting mixture is melt-kneaded using a kneader, an extruder or the like. The resulting kneaded mixture is ground into fine powder with a jet mill or the like, and then classified by a wind classifier to obtain toner particles having a desired particle diameter. Furthermore, an external additive is added, to thereby complete a final toner.

In case the color toner is prepared by the polymerization method, a suspension polymerization method and an emulsion polymerization method can be mainly applied. In the case of preparing by the suspension polymerization method, monomers such as styrene, butyl acrylate, 2-ethylhexyl acrylate and the like, a crosslinking agent such as divinylbenzene, a chain transfer agent such as dodecylmercaptan, a colorant, a charge control agent, an infrared absorbing agent of the present invention, waxes, and a polymerization initiator are mixed to prepare a monomer composition. Then, the monomer composition is charged in an aqueous phase containing a suspension stabilizer and a surfactant such as tricalcium phosphate, polyvinyl alcohol or the like and, after preparing an emulsion using a rotor-stator emulsifier, a high pressure emulsifier, ultrasonic emulsifier or the like, polymerization of the monomer is conducted by heating. After the completion of the polymerization, the resulting particles are washed and dried and an external additive is added to obtain final toner particles.

In case the color toner is prepared by the emulsion polymerization method, monomers such as styrene, butyl acrylate, 2-ethylhexyl acrylate and the like and, if necessary, a surfactant such as sodium dodecylsulfate are added in water containing a water-soluble polymerization initiator dissolved therein, followed by heating and further polymerization while stirring to obtain resin particles. Powders of an infrared absorbing agent of the present invention, a colorant, a charge control agent and waxes are added in a suspension containing resin particles dispersed therein, and then the resin particles and the powders of the infrared absorbing agent are subjected to the hetero-agglomeration by controlling the pH, stirring intensity and temperature of the suspension. Furthermore, the hetero-agglomerate is melted by heating the system to the glass transition temperature or higher to obtain toner particles. Then, the resulting particles are washed and dried and an external additive is added to obtain final toner particles.

The present invention is also directed to a color image forming method using the color toner of the present invention. The color image forming method of the present invention includes the steps of forming an electrostatic latent image by image exposure, visualizing the electrostatic latent image by development, transferring the visualized image onto the recording medium and fixing the transferred image, as described previously, while a developing agent containing the color toner of the present invention is used, unlike a conventional method.

Also according to the present invention, in the step of transferring the image which has been visualized by the use of the developing agent onto the recording medium and then fixing the image, the photofixing system is employed to fix the toner. A flash can be advantageously used in the photofixation of the transferred toner image. The flash may have wavelengths selected from a broad region reaching near infrared as well as the visible region, in accordance to the specifications of the flash fixing device to be used. Xenon lamp can be used to generate the flash which can efficiently fix the toner. A light intensity of the Xenon lamp is preferably within a range from 1.0 to 6.0 J/cm$^2$ in terms of energy density per unit area in a single flash. An energy density of light less than 1.0 J/cm$^2$ is unable to fix the toner and an energy density higher than 6.0 J/cm$^2$ may cause formation of toner voids or burning of paper. The energy density S (J/cm$^2$) of light is given as follows.

$$S=((1/2)\times C\times V^2)/(u\times l)/(n\times f)$$

where n is the number of lamps, f is the lighting frequency (Hz), V is the input voltage, C is the capacitance of a capacitor ($\mu$F), u is the traveling speed of the process (mm/s) and l is the printing width (mm).

Although duration of one flashing cycle of the flash may be set within a wide range according to the energy density of flash, it is preferably in a range from 500 to 3,000 $\mu$/s. Too short a flashing cycle of the flash may be unable to melt the toner sufficiently to increase the fixing rate. Too long a flashing cycle of the flash may, on the other hand, cause overheating of the toner which is fixed on the recording medium.

To obtain long-term stability, together with good fixability of the color toner, it is also recommended to employ flash fixation in combination with halogen photofixation.

More specifically, the color image forming method of the present invention may be applied similarly to the image forming method of the prior art, except for the difference described above. By way of a preferable example, formation of an electrostatic latent image by image exposure can be carried out, after uniformly charging the surface of a photoconductive insulator such as a photosensitive drum with positive or negative electrostatic charge, by partially erasing the electrostatic charge deposited on the insulator by irradiating the photoconductive insulator with light in the pattern of the image with any of various means, thereby leaving the electrostatic latent image behind. For example, the surface charge can be erased from particular portions by irradiating with laser beam, so as to form the electrostatic latent image on the photoconductive insulator according to the image information.

Then the electrostatic latent image thus formed is visualized by development. This can be done by depositing the fine powder of the developing agent, which includes the toner of the present invention, on the latent image portion where the electrostatic charge remains on the photoconductive insulator.

After the developing step, the visualized image is transferred onto the recording medium. This can be generally done by electrostatically transferring the toner image onto a recording medium such as recording paper.

Finally, the toner image transferred in the transfer step described above is melted and fixed on the recording medium by the flash fixing method according to the present invention. An intended duplicate (print or the like) is obtained through the series of processes described above.

The method of forming color images based on electrophotography is well known in this technical field and, accordingly, a description thereof will be omitted herein. Satisfactory effects can be also obtained by applying another image forming method, for example, ionography, in place of electrophotography.

The present invention is also directed to a color image forming apparatus. The color image forming apparatus of the present invention, typically the electrophotographic apparatus is also well known in this technical field and, accordingly, a description thereof will be omitted herein. For reference, an example of electrophotographic apparatus which can be advantageously used in the present invention is shown in FIG. 1.

In the electrophotographic apparatus shown in FIG. 1, a developing agent 11 prepared by mixing the color toner of the present invention and a carrier is stirred with a stirring screw 12 so as to effect friction charging. The developing agent 11 which is charged by friction is guided through a predetermined circulation path via a developing roller 13 to reach a photosensitive drum 14. The photosensitive drum 14 may be constituted from a photosensitive material which has photoconductivity, for example organic photosensitive material such as polysilane, phthalocyanine, phthalopolymethine or inorganic photosensitive material such as selenium and amorphous silicon, or an insulating material, depending on the method of forming the latent image. A photosensitive material made of amorphous silicon is particularly preferable in view of long lifetime thereof.

The surface of the photosensitive drum 14 which has received the developing agent 11 transferred thereto is electrostatically charged by a preliminary charger 15 located behind the drum in the rotating direction thereof, while the electrostatic latent image is formed thereon by the image light applied by an exposure device (not shown) according to the image information. The preliminary charger 15 may comprise a corona discharging mechanism such as corotron or scorotron, or a contact charging mechanism such as brush charger. The exposure device may be constituted by using various optical systems as the light source such as laser optical system, LED optical system or liquid crystal optical system. Thus the developing agent 11 which has been charged and transferred to the photosensitive drum 14 is deposited on the drum surface in the area of electrostatic latent image, thereby forming the visualized toner image.

The toner image 11 formed on the photosensitive drum 14 is moved onto the transfer section 16 and is transferred onto a recording medium (paper, film, etc.) 21. The transfer section 16 may have various constitutions depending on the type of force used in the transfer process, such as electrostatic force, mechanical force or viscous force. If electrostatic force is used, for example, a corona transferring device, a roll transferring device, a belt transferring device, or the like, can be employed.

The recording medium 21 is guided in the direction of the arrow, so that the toner image is fixed thereon below the flash fixing device 18. The toner image on the recording medium 21 is heated by the flash fixing device 18 so as to melt and penetrate into the recording medium 21 thereby to be fixed. When the fixing step is completed, a fixed image 22 is obtained. Modification such as use of a halogen photofixing device (not shown) in combination with the flash fixing device may be made.

The toner which is left without being used in the transfer step in the toner image 11 on the photosensitive drum14 is discharged by a discharger (not shown) and removed from the surface of the photosensitive drum14 by a cleaning device (a blade in the case shown in the drawing) 17. The cleaning device may be, besides the blade, magnetic brush cleaner, electrostatic brush cleaner or magnetic roller cleaner.

EXAMPLES

The following Examples further illustrate the present invention in detail. It should be noted, however, that the present invention is not limited to these Examples.

Preparation Example 1

(1) Preparation of Carrier

Magnetite particles 60 μm in diameter to be used as the core of carrier particles were coated with an acrylic resin (BR-85 manufactured by Mitsubishi Rayon Co., Ltd.) in a fluidized bed and dried. The amount of the coating material is 2% by weight based on the amount of core material of the carrier. A magnetite carrier coated with the acrylic resin was thus obtained.

(2) Preparation of Infrared Absorbing Fine Composite Particles

Two kids of fine particle samples summarized in Table 1 were prepared in the following manner.

Preparation of Sample 1:

First Layer: Titania Coating 1 kg of silica beads (average particle diameter: 1 μm, manufactured by NIPPON SHOKUBAI CO., LTD.) were dispersed in 10 liter of ethanol and maintained in a water bath at 55° C. To the suspension, 1 kg of titanium ethoxide, 500 g of ammonia water (concentration: 30%) and 1 kg of water were added and the reaction was conducted while stirring for 2 hours. Silica beads coated with a titania coating were dried and then subjected to a heat treatment. After washing, filtration and drying at 100° C. for 3 hours, a heat treatment was conducted at 650° C. for 30 minutes. As a result, titania-coated silica beads (fine particles A) were obtained.

Second Layer: Silica Coating 1 kg of the resulting fine particles A were dispersed in 10 liter of ethanol and maintained in a water bath at 55° C. To the suspension, 1 kg of silicon ethoxide, 500 g of ammonia water (concentration: 30%) and 1 kg of water were added and the reaction was conducted while stirring for 2 hours. A silica coating was dried and then subjected to a heat treatment. After washing, filtration and drying at 100° C. for 3 hours, a heat treatment was conducted at 650° C. for 30 minutes. As a result, silica beads coated with silica and titania (fine particles B) were obtained.

Third Layer: Titania Coating 1 kg of the resulting fine particles B were dispersed in 10 liter of ethanol and maintained in a water bath at 55° C. To the suspension, 1 kg of titanium ethoxide, 500 g of ammonia water (concentration: 30%) and 1 kg of water were added and the reaction was conducted while stirring for 2 hours. A titania coating was dried and then subjected to a heat treatment. After washing, filtration and drying at 100° C. for 3 hours, a heat treatment was conducted at 650° C. for 30 minutes. As a result, silica beads (fine particles C), which are triple coated with silica and titania, were obtained.

Fourth Layer: Silica Coating 1 kg of the resulting fine particles C were dispersed in 10 liter of ethanol and maintained in a water bath at 55° C. To the suspension, 1 kg of silicon ethoxide, 500 g of ammonia water (concentration: 30%) and 1 kg of water were added and the reaction was conducted while stirring for 2 hours. A silica coating was dried and then subjected to a heat treatment. After washing, filtration and drying at 100° C. for 3 hours, a heat treatment was conducted at 650° C. for 30 minutes. As a result, silica beads (sample 1), which are quadruple coated with silica and titania and have a maximum infrared absorption wavelength of 900 nm, were obtained.

Preparation of Sample 2:

The same procedure as in preparation of the sample 1 was repeated, except that beads (average particle diameter: 1 μm, manufactured by BASF Co.) of carbonyl iron powders were used in place of the silica beads in this example. As a result, silica beads (sample 2), which are quadruple coated with silica and titania and has a maximum infrared absorption wavelength of 950 nm, were obtained.

(3) Preparation of Polyester Resin 1.0 mols of polyoxypropylene(2.2)-2,2-bis(4-hydroxyphenyl)propane, 9.0 mols of polyoxyethylene(2.2)-2,2-bis(4-hydroxyphenyl)propane, 4.6 mols of terephthalic acid, 4.6 mols of isophthalic acid and 5.0 g of dibutyltin oxide were charged in a four-necked glass flask equipped with a thermometer, a stainless steel stirrer, a flow-down type condenser and a glass nitrogen introducing tube. The reaction mixture in the four-necked flask was reacted in a mantle heater in a nitrogen gas flow at 220° C. for 3 hours, and then at 240° C. for 3 hours, and the reaction was further continued at the same temperature under reduced pressure of 60 mmHg for two hours, thus completing the reaction. As a result, a polyester resin having a weight-average molecular weight of 5,000, a glass transition temperature of 65° C., a softening point of 110° C. and an acid value of 20 was obtained.

(4) Preparation of Color Toner

Red color toners for flash fixation having different compositions shown in Table 3 were prepared. In the table, infrared absorbing agents (commercially available products) used in combination are summarized in Table 2.

Preparation of Toner SCR-1:

As described in Table 3 below, 0.1 parts by weight of the sample 1 prepared in the step described above, 95 parts by weight of a polyester resin, 5 parts by weight of IRGALITE RED 3RS (manufactured by Ciba Geigy), 1 part by weight of a charge control agent (CCA-100, manufactured by CHUO SYNTHETIC CHEMICALS CO., LTD.) and 0.5 parts by weight of a charge wax, NP105 (manufactured by Mitsui Chemicals) were prepared as toner components. All the toner components were charged in a Henschel mixer for preliminary mixing. Then the mixture was melted and kneaded in an extruder. After cooling the mixture to solidify, the solid mixture was ground by a hammer mill and then ground into fine powder in a jet mill. The fine powder thus obtained was classified by an air flow classifier, thereby to obtain fine particles colored in red having a volume-average particle diameter of 8.5 μm. To the fine particles of toner thus obtained, 0.5 parts by weight of hydrophobic fine silica particles (H3004 manufactured by Clariant Japan Co., Ltd.) were externally added in the Henschel mixer. As a result, a toner SCR-1 was obtained.

Preparation of Toners SCR-2 to SCR-12:

In the same manner as in case of the preparation of the toner SCR-1, toners were prepared except that the materials and each amount thereof were changed to those described in Table 3 below. After the fine particles colored in red having a volume-average particle diameter of 8.5 μm were obtained, external additives were added. As a result, toners SCR-2 to SCR-12 were obtained.

Preparation of Toner SCR-13:

As described in Table 3 below, 95 parts by weight of the polyester resin prepared in the step described above, 5 parts by weight of IRGALITE RED 3RS (manufactured by Ciba Geigy), 1 part by weight of a charge control agent (CCA-100, manufactured by CHUO SYNTHETIC CHEMICALS CO., LTD.) and 0.5 parts by weight of NP105 (manufactured by Mitsui Chemicals) were prepared as toner components. All the toner components were charged in a Henschel mixer for preliminary mixing. Then the mixture was melted and kneaded in an extruder. After cooling the mixture to solidify, the solid mixture was ground by a hammer mill and then ground into fine powder in a jet mill. The fine powder thus obtained was classified by an air flow classifier, thereby to obtain fine particles colored in red having a volume-average particle diameter of 8.5 μm. To the fine particles of toner thus obtained, 0.5 parts by weight of hydrophobic fine silica particles (H3004 manufactured by Clariant Japan Co., Ltd.) and 0.01 parts by weight of the sample 1 prepared in the step described above were externally added in the Henschel mixer. As a result, a toner SCR-13 was obtained.

Preparation of Toners SCR-14 to SCR-16:

In the same manner as in case of the preparation of the toner SCR-13, toners were prepared except that the amount of the sample 1 to be externally added was changed to those described in Table 3 below. After the fine particles colored in red having a volume-average particle diameter of 8.5 μm were obtained, external additives were added. As a result, toners SCR-14 to SCR-16 were obtained.

Preparation of Toner SCR-17:

In the same manner as in case of the preparation of the toner SCR-13, a toner was prepared except that the materials and each amount thereof were changed to those described in Table 3 below. After the fine particles colored in red having a volume-average particle diameter of 8.5 μm were obtained, external additives were added. As a result, a toner SCR-17 was obtained.

Examples 1 to 16 and Comparative Example 1

Toners SCR-1 to SCR-17 prepared as described above were used in the printing test employing the flash fixing system.

Figure 2:
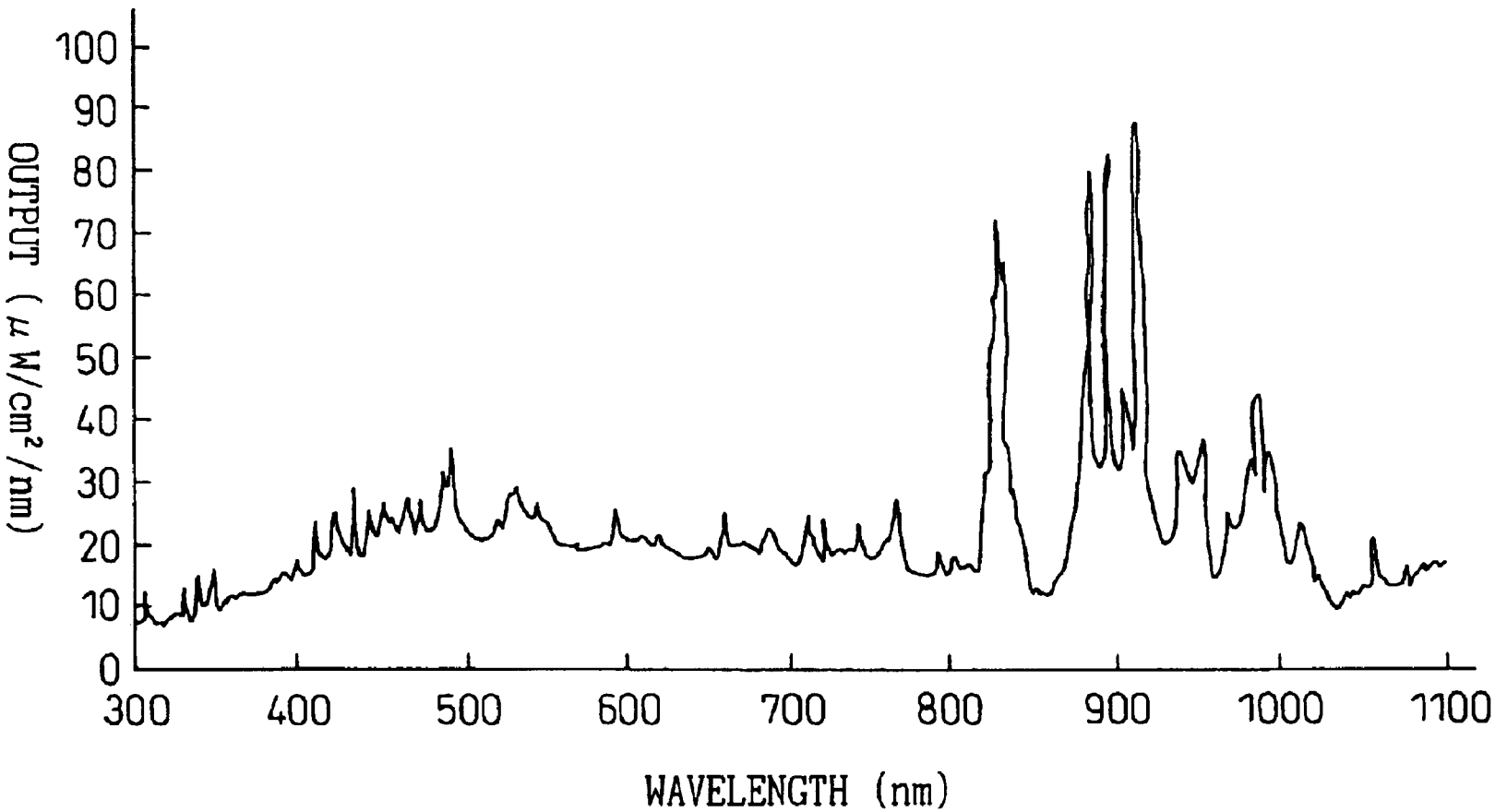
FIG. 2 is a light emission spectrum of Xenon flashlight.

4.5% by weight of each of the toners described above was mixed with 95.5% by weight of the carrier prepared as described above, thereby to make a developing agent. The developing agent was set in a high speed printing machine (modification of PS2160 manufactured by Fujitsu Ltd.) having a Xenon lamp as the fixing light source. Then lines were printed at the luminescent energy (energy of fixing light) of 2.2 J/cm$^2$ and a printing rate of 8,000 lines/min. on a plain paper (NIP-1500LT, manufactured by Kobayashi Kirokushi Co., Ltd.) used as the recording medium. Light emitted by the Xenon lamp has a high emission intensity at a wavelength within a range from 700 to 1500 nm as schematically shown in the spectral line of FIG. 2, and the duration of one flash cycle was 1000 μs. Prints thus obtained were evaluated for the following performances in accordance with the following criteria:

(1) Charge amount (high temperature/high humidity HH and low temperature/low humidity LL)
(2) Ratio of charge amount (charge retention)
(3) Fixation % of toner
(4) Fixability
(5) Print density
(6) Fogging Measurement of Charge Amount:

The charge amount was measured on the surface of the plain paper, on which the toner image was fixed, using a magnet blow-off method. The measuring device used is a blow-off charge amount measuring device and the measurement was conducted under two kinds of conditions, for example, high temperature/high humidity HH (32° C., 80%RH) and low temperature/low humidity LL (15° C., 20%RH). The absolute value of the charge amount is most suitably within a range from 15 to 25 μC/g. When the charge amount is 25 μC/g or less, the print density is poor. On the other hand, when the charge amount is 15 μC/g or less, fogging occurs.

Evaluation of Charge Retention:

A ratio of the HH charge amount to the LL charge amount was determined and used as a measure for evaluation of the charge retention. A print having the charge retention of 70% or more was rated as good (○).

Measurement of Fixation % of Toner:

The print density of the image on the plain paper, on which the toner image was fixed, was measured as the optical density (density of Status A) first. Then after lightly sticking an adhesive tape (Scotch™ Mending Tape manufactured by Sumitomo 3M) on the toner image printed on the same paper, a cylinder of steel 100 mm in diameter and 20 mm in width was rolled over the tape in contact therewith, and then the tape was pulled off the paper. Then, the print density (optical density) of the image printed on the paper from which the tape was removed was measured again. Percentage of the optical density after removing the tape to the optical density before removing the tape (100%) was calculated and recorded as the fixation (%) of toner. A Macbeth PCM meter was used in the measurement of the optical density.

Judgment of Fixability:

The fixability of each toner was rated from the fixation (%) of the toner according to the following criteria.

Below 70% x

From 70% to below 95% ○

95% or higher ◎

Measurement of Print Density:

The print density of the image on the surface of the plain paper, on which the toner image was fixed, was measured as the optical density (density of Status A) using a Macbeth PCM meter. The measurement was conducted under two kinds of conditions, for example, high temperature/high humidity HH (32° C., 80%RH) and low temperature/low humidity LL (15° C., 20%RH). A print having a print density of 1.3 or more was rated as good (○).

Measurement of Fogging:

Prints were checked to see whether fogging (stain on the background) occurred or not on the plain paper, on which the tone image was fixed. A print having no fogging was rated as good (○), a print with slight fogging was rated as fair (Δ), and a print having fogging which was not practically permissible was rated as bad (x).

The results of the measurements and evaluations described above are summarized in Table 3 below.

TABLE 1

| Core and manufacturer | Sample 1 Silica beads (NIPPON SHOKUBAI CO., LTD.) | Sample 2 Carbonyl iron powders (BASF) |
|---|---|---|
| Average particle diameter of core | 1 μm | 1 μm |
| Film thickness of first layer ($SiO_2$) | 55 nm | 45 nm |
| Film thickness of second layer ($TiO_2$) | 68 nm | 68 nm |
| Film thickness of third layer ($SiO_2$) | 53 nm | 49 nm |
| Film thickness of fourth layer ($TiO_2$) | 68 nm | 69 nm |
| Maximum infrared absorption wavelength[1)] | 900 nm | 950 nm |

[1)]as measured by reflection infrared absorption spectrum

TABLE 2

| Infrared absorbing agent (commercially available product) | Compound | Manufacturer | Maximum infrared absorption wave-length (nm)[1)] |
|---|---|---|---|
| IRG-002 | Aminium | NIPPON KAYAKU CO., LTD. | 950 |
| IRG-040 | Diimonium | NIPPON KAYAKU CO., LTD. | 1060 |
| UUHP | $Yb_2O_3$ | Shin-Etsu Chemical Co., Ltd. | 950 |
| CY-10 | Cyanine | NIPPON KAYAKU CO., LTD. | 800 |
| IR-820 | Polymethine | NIPPON KAYAKU CO., LTD. | 820 |
| TL30S | Tin oxide | CATALYSTS&CHEMICALS IND. CO., LTD. | 1200 |

[1)]as measured by reflection infrared absorption spectrum

TABLE 3

| Components | Name | Example 1 SCR-1 | Example 2 SCR-2 | Example 3 SCR-3 | Example 4 SCR-4 | Example 5 SCR-5 | Example 6 SCR-6 |
|---|---|---|---|---|---|---|---|
| Pigment | IRGALITE RED 3RS (Ciba Geigy) | 5.0 | 5.0 | 5.0 | 5.0 | 5.0 | 5.0 |
| Binder | Polyester resin | 95.0 | 95.0 | 95.0 | 95.0 | 95.0 | 85.0 |
| Charge control agent (CCA) | CCA-100 (CHUO SYNTHETIC CHEMICALS CO., LTD.) | 1.0 | 1.0 | 1.0 | 1.0 | 1.0 | 1.0 |
| Fine particles of the present invention | Sample 1 | 0.1 | 1.0 | 10.0 | 40.0 | 50.0 | |
| | Sample 2 | | | | | | 10.0 |
| Other infrared absorbing agent | IRG-002 | | | | | | |
| | IRG-040 | | | | | | |
| | UUHP | | | | | | |
| | CY-10 | | | | | | |
| | IR-820 | | | | | | |
| | TL30S | | | | | | |
| Wax | NP105 (Mitsui Chemicals) | 0.5 | 0.5 | 0.5 | 0.5 | 0.5 | 0.5 |
| External additive | H3004 (Clariant) | 0.5 | 0.5 | 0.5 | 0.5 | 0.5 | 0.5 |
| | Sample 1 | | | | | | |
| Evaluation | LL charge amount (−μC/g) | 25.2 | 24.9 | 23.1 | 22.2 | 21.2 | 21.5 |
| | HH charge amount (−μC/g) | 23.5 | 21.9 | 19.8 | 17.9 | 16.5 | 15.6 |
| | Ratio HH/LL (charge retention) | 93.3 | 88.0 | 85.7 | 80.6 | 77.8 | 72.6 |
| | Fixation (%) | 55.0 | 80.0 | 90.4 | 85.2 | 75.2 | 84.6 |
| | Judgment of fixability | X | ○ | ○ | ○ | Δ | ○ |
| | Print density (LL/HH) | ○/○ | ○/○ | ○/○ | ○/○ | ○/○ | ○/○ |
| | Fogging (LL/HH) | ○/○ | ○/○ | ○/○ | ○/○ | ○/○ | ○/○ |

| Components | Name | Comp. Example 1 SCR-7 | Example 7 SCR-8 | Example 8 SCR-9 | Example 9 SCR-10 | Example 10 SCR-11 | Example 11 SCR-12 |
|---|---|---|---|---|---|---|---|
| Pigment | IRGALITE RED 3RS (Ciba Geigy) | 5.0 | 5.0 | 5.0 | 5.0 | 5.0 | 5.0 |
| Binder | Polyester resin | 94.5 | 94.5 | 94.5 | 94.5 | 94.5 | 94.5 |
| Charge control agent (CCA) | CCA-100 (CHUO SYNTHETIC CHEMICALS CO., LTD.) | 1.0 | 1.0 | 1.0 | 1.0 | 1.0 | 1.0 |
| Fine particles of the present invention | Sample 1 | 10.0 | 10.0 | 10.0 | 10.0 | 10.0 | 10.0 |
| | Sample 2 | | | | | | |
| Other infrared absorbing agent | IRG-002 | 0.5 | | | | | |
| | IRG-040 | | 0.5 | | | | |
| | UUHP | | | 0.5 | | | |
| | CY-10 | | | | 0.5 | | |
| | IR-820 | | | | | 0.5 | |
| | TL30S | | | | | | 0.5 |
| Wax | NP105 (Mitsui Chemicals) | 0.5 | 0.5 | 0.5 | 0.5 | 0.5 | 0.5 |
| External additive | H3004 (Clariant) | 0.5 | 0.5 | 0.5 | 0.5 | 0.5 | 0.5 |
| | Sample 1 | | | | | | |
| Evaluation | LL charge amount (−μC/g) | 20.6 | 26.3 | 23.1 | 21.3 | 18.9 | 23.2 |
| | HH charge amount (−μC/g) | 19.6 | 20.8 | 19.6 | 18.2 | 16.5 | 19.3 |
| | Ratio HH/LL (charge retention) | 95.1 | 79.1 | 84.8 | 85.4 | 87.3 | 83.2 |
| | Fixation (%) | 95.6 | 98.2 | 98.3 | 92.4 | 94.3 | 94.0 |

TABLE 3-continued

| | | | | | | | |
|---|---|---|---|---|---|---|---|
| | Judgment of fixability | ◎ | ◎ | ◎ | ○ | ○ | ○ |
| | Print density (LL/HH) | ○/○ | ○/○ | ○/○ | ○/○ | ○/○ | ○/○ |
| | Fogging (LL/HH) | ○/○ | ○/○ | ○/○ | ○/○ | ○/○ | ○/○ |
| Components | Name | Example 12 SCR-13 | Example 13 SCR-14 | Example 14 SCR-15 | Example 15 SCR-16 | Example 16 SCR-17 | |
| Pigment | IRGALITE RED 3RS (Ciba Geigy) | 5.0 | 5.0 | 5.0 | 5.0 | 5.0 | |
| Binder | Polyester resin | 95.0 | 95.0 | 95.0 | 95.0 | 94.5 | |
| Charge control agent (CCA) | CCA-100 (CHUO SYNTHETIC CHEMICALS CO., LTD.) | 1.0 | 1.0 | 1.0 | 1.0 | 1.0 | |
| Fine particles of the present invention | Sample 1 | | | | | 10.0 | |
| | Sample 2 | | | | | | |
| Other infrared absorbing agent | IRG-002 | | | | | | |
| | IRG-040 | | | | | | |
| | UUHP | | | | | | |
| | CY-10 | | | | | 0.5 | |
| | IR-820 | | | | | | |
| | TL30S | | | | | | |
| Wax | NP105 (Mitsui Chemicals) | 0.5 | 0.5 | 0.5 | 0.5 | 0.5 | |
| External additive | H3004 (Clariant) | 0.5 | 0.5 | 0.5 | 0.5 | 0.5 | |
| | Sample 1 | 0.01 | 0.1 | 1.0 | 10.0 | 1.0 | |
| Evaluation | LL charge amount (−μC/g) | 22.3 | 21.5 | 20.3 | 19.6 | 22.5 | |
| | HH charge amount (−μC/g) | 20.1 | 19.3 | 16.5 | 14.5 | 20.5 | |
| | Ratio HH/LL (charge retention) | 90.1 | 89.8 | 81.3 | 74.0 | 91.1 | |
| | Fixation (%) | 60.2 | 80.2 | 85.1 | 65.6 | 99.9 | |
| | Judgment of fixability | X | ○ | ○ | X | ◎ | |
| | Print density (LL/HH) | ○/○ | ○/○ | ○/○ | ○/○ | ○/○ | |
| | Fogging (LL/HH) | ○/○ | ○/○ | ○/○ | ○/Δ | ○/○ | |

Example 17

In this example, a blue color toner for flash fixation was prepared and a printing test was conducted by employing a flash fixing system.

Employing, as the binder resin, a polyester resin having an acid value of 30 mg/KOH and a softening temperature of 114° C., comprising terephthalic acid, an ethylene oxide adduct of bisphenol A and a proylene oxide as essential constituent monomers, 5% by weight of a phthalocyanine pigment (B2G, manufactured by Clariant Co., Ltd.), 3% by weight of a calixarene compound (E-89, manufactured by Orient Chemicals) and 2% by weight of the fine particles (sample 1) prepared in Preparation Example 1 were added to the polyester resin, and then the mixture was melt-kneaded, ground and classified to obtain a toner matrix having an average particle diameter of 8.5 μm.

To the resulting toner matrix, 0.35 parts by weight of a hydrophobic silica (H-2000, manufactured by Clariant Co., Ltd.) as an external additive was added to obtain a toner colored in blue. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −20 μC/g.

Subsequently, the resulting developing agent was set in a high sped printing machine (modification of PS2160, manufactured by Fujitsu Ltd.) and then the toner was fixed on a plain paper (NIP-1500LT, manufactured by Kobayashi Kirokushi Co., Ltd.) by applying a Xenon flashlight having a high emission intensity at a wavelength within a range from 700 to 1500 nm to obtain a printed image.

The fixability of the resulting printed image was examined in the following manner. First, the optical density ($OD_1$) was measured in the printed image of 1 inch (25.4 mm) square. Then after sticking an adhesive tape (Scotch™ Mending Tape manufactured by Sumitomo 3M) on the same printed image, the tape was pulled off. Then, the optical density ($OD_2$) of the printed image after pulling off was measured again. A Macbeth PCM meter was used in the measurement of the optical density. The fixation % was calculated by the following equation.

$$\text{Fixation } (\%) = OD_2/OD_1 \times 100$$

As a result, it has been found that the printed image has excellent fixability with a fixation % of 95%. The printed image had good image quality with less stain such as fogging on the background.

Example 18

In this example, a red color toner for flash fixation was prepared and a printing test was conducted by employing a flash fixing system.

The same procedure as in Example 17 was repeated, except that 4% by weight of a naphtholazo pigment (KET RED 338, manufactured by DIC) was added in place of the phthalocyanine pigment and 1% by weight of ytterbium phosphate was added as an auxiliary infrared absorbing agent in this example.

In the same procedure as in Example 17, kneading of the toner, grinding and external addition were conducted to prepare a toner colored in red, and then the toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −22 μC/g.

Furthermore, the resulting developing agent was subjected to the same printing and evaluation tests as those in Example 17. As a result, it has been found that the printed image has excellent fixability of 90%. The printed image had good image quality with less stain such as fogging on the background.

Example 19

In this example, a blue color toner for flash fixation was prepared and a printing test was conducted by employing a flash fixing system.

Employing, as the binder resin, a polyester resin (weight-average molecular weight: 7,000, glass transition temperature: 58° C.) having an acid value of 30 mg/KOH and a softening temperature of 114° C., comprising terephthalic acid, an ethylene oxide adduct of bisphenol A and a propylene oxide as essential constituent monomers, 5% by weight of a phthalocyanine pigment (B2G, manufactured by Clariant Co., Ltd.), 3% by weight of a calixarene compound (E-89, manufactured by Orient Chemicals) and 2% by weight of an azulene dye represented by the following formula:

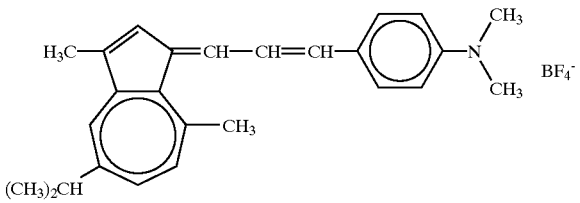

(λmax=760 nm) were added to the polyester resin and, then, the mixture was melt-kneaded, ground and classified to obtain a toner matrix having an average particle diameter of 8.4 μm.

To the resulting toner matrix, 0.35 parts by weight of a hydrophobic silica (H-2000, manufactured by Clariant Co., Ltd.) as an external additive was added to obtain a toner colored in blue. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −20 μC/g.

Subsequently, the resulting developing agent was set in a high sped printing machine (modification of PS2160, manufactured by Fujitsu Ltd.) and then the toner was fixed on a plain paper (NIP-1500LT, manufactured by Kobayashi Kirokushi Co., Ltd.) by applying Xenon flashlight having a high emission intensity at a wavelength within a range from 700 to 1500 nm to obtain a printed image.

The fixability of the resulting printed image was examined in the following manner. First, the optical density ($OD_1$) was measured in the printed image of 1 inch (25.4 mm) square. Then after sticking an adhesive tape (Scotch™ Mending Tape manufactured by Sumitomo 3M) on the same printed image, the tape was pulled off. Then, the optical density ($OD_2$) of the printed image after pulling off was measured again. A Macbeth PCM meter was used in the measurement of the optical density. The fixation % was calculated by the following equation.

$$\text{Fixation } (\%) = OD_2/OD_1 \times 100$$

As a result, it has been found that the printed image has excellent fixability with the fixation % of 95%. The printed image had good image quality with less stain such as fogging on the background.

Comparative Example 2

The same procedure as in Example 19 was repeated, except that the addition of the azulene dye was omitted in this example, for comparison.

In the same manner as in Example 19, the charge amount of the developing agent was measured by a blow-off charge amount measuring device (manufactured by Toshiba Chemical). As a result, it has been found that the charge amount is −20 μC/g and is comparable with the toner of Example 19. These results showed that the azulene dye used in Example 19 exerts a small influence on the chargeability of the toner.

Subsequently, a printing test was conducted in the same manner as in Example 19. As a result, it has been found that the resulting printed image has such poor fixability that the image is broken when rubbed with fingers and therefore the toner has a quality that is scarcely fit for practical use. The fixability was 30% or less. These results showed that the azulene dye used in Example 19 exclusively contributes to the flash fixability of the toner.

Preparation Example 2

(1) Preparation of carrier

In the same manner as in Preparation Example 1, a magnetite carrier was prepared.

(2) Preparation of polyester resin

In the same manner as in Preparation Example 1, a polyester resin having a weight-average molecular weight of 5,000, a glass transition temperature of 65° C., a softening point of 110° C. and an acid value of 20 mg/KOH was prepared.

(3) Preparation of color toner

Red color toners for flash fixation having different compositions shown in Table 5 were prepared. In the table, the cyanine compound used as the infrared absorbing agent is summarized in Table 4. With respect to infrared absorbing agents (commercially available products) used in combination with the cyanine compound, refer to Table 1.

Preparation of Toner SCR-1C:

As described in Table 5 below, 0.05 parts by weight of the cyanine compound (CY-10-1) of the present invention, 89 parts by weight of a polyester resin, 10 parts by weight of IRGALITE RED 3RS (manufactured by Ciba Geigy), 1 part by weight of a charge control agent (CCA-100, manufactured by CHUO SYNTHETIC CHEMICALS CO., LTD.) and 0.5 parts by weight of a wax, NP105 (manufactured by Mitsui Chemicals) were prepared as toner components. All the toner components were charged in a Henschel mixer for preliminary mixing. Then the mixture was melted and kneaded in an extruder. After cooling the mixture to solidify it, the solid mixture was ground by a hammer mill and then ground into fine powder in a jet mill. The fine powder thus obtained was classified by an air flow classifier, thereby to obtain fine particles colored in red having a volume-average particle diameter of 8.5 μm. To the fine particles of toner thus obtained, 0.5 parts by weight of hydrophobic fine silica particles (H3004 manufactured by Clariant Japan Co., Ltd.) were externally added in the Henschel mixer. As a result, a toner SCR-1C was obtained.

Preparation of Toners SCR-2C to SCR-10C:

In the same manner as in case of the preparation of the toner SCR-1C, toners were prepared except that the materials and each amount thereof were changed to those described in Table 5 described below. After the fine particles colored in red having a volume-average particle diameter of 8.5 μm were obtained, external additives were added. As a result, toners SCR-2C to SCR-10C were obtained.

Examples 20 to 27 and Comparative Examples 3 to 4

Toners SCR-1C to SCR-10C prepared as described above were used in the printing test employing the flash fixing system. The procedure of the printing test is the same as that employed in Examples 1 to 16.

4.5% by weight of each of the toners described above was mixed with 95.5% by weight of the carrier prepared as described above, thereby to make a developing agent. The developing agent was set in a high sped printing machine (modification of PS2160 manufactured by Fujitsu Ltd.) having a Xenon lamp as the fixing light source. Then lines were printed at the energy of fixing light of 2.2 J/cm$^2$ and a printing rate of 8,000 lines/min. on a plain paper (NIP-1500LT, manufactured by Kobayashi Kirokushi Co., Ltd.) used as the recording medium. Prints thus obtained were evaluated for the following performance:

(1) Charge amount (high temperature/high humidity HH and low temperature/low humidity LL)

(2) Ratio of charge amount (charge retention)
(3) Fixation % of toner
(4) Fixability
(5) Print density
(6) Fogging The results of the measurements and evaluations shown in Table 5 were obtained.

TABLE 4

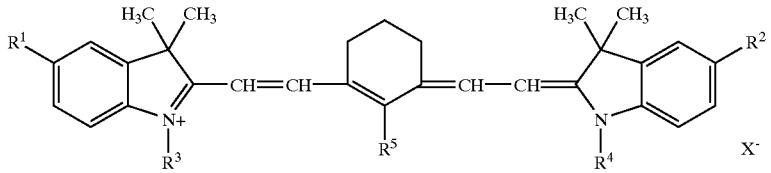

| Infrared absorbing agent | $R^1$ | $R^2$ | $R^3$ | $R^4$ | $R^5$ | X | Manufacturer | Maximum infrared absorption wavelength (nm)[1)] |
|---|---|---|---|---|---|---|---|---|
| CY-10-1 | $C_2H_5$ | $C_2H_5$ | $C_2H_5$ | $C_2H_5$ | $C_2H_5$ | Toluene sulfonic acid | NIPPON KAYAKU CO., LTD. | 800 |
| CY-10-2 | $CH_3$ | $CH_3$ | H | $CH_3$ | $CH_3$ | Nitric acid | NIPPON KAYAKU CO., LTD. | 780 |

[1)]in acetone solvent

TABLE 5

| Components | Name | Comp. Example 3 SCR-1C | Example 20 SCR-2C | Example 21 SCR-3C | Example 22 SCR-4C | Example 23 SCR-5C |
|---|---|---|---|---|---|---|
| Pigment | IRGALITE RED 3RS (Ciba Geigy) | 10.0 | 10.0 | 10.0 | 10.0 | 10.0 |
| Binder | Polyester resin | 89.0 | 88.7 | 88.5 | 88.0 | 79.0 |
| Charge control agent (CCA) | CCA-100 (CHUO SYNTHETIC CHEMICALS CO., LTD.) | 1.0 | 1.0 | 1.0 | 1.0 | 1.0 |
| Cyanine compound of the present invention (infrared absorbing agent) | CY-10-1 | 0.05 | 0.3 | 0.5 | 1.0 | 10.0 |
| | CY-10-2 | | | | | |
| Other infrared absorbing agent | IRG-002 | | | | | |
| | IRG-040 | | | | | |
| | UUHP | | | | | |
| Auxiliary fixing agent | NP105 (Mitsui Chemicals) | 0.5 | 0.5 | 0.5 | 0.5 | 0.5 |
| External additive | H3004 (Clariant) | 0.5 | 0.5 | 0.5 | 0.5 | 0.5 |
| Evaluation | LL charge amount (−μC/g) | 25.2 | 24.3 | 23.5 | 23 | 22.6 |
| | HH charge amount (−μC/g) | 24.5 | 21.3 | 19.8 | 18.6 | 17.5 |
| | Ratio HH/LL (charge retention) | 97.2 | 87.7 | 84.3 | 80.9 | 77.4 |
| | Fixation (%) | 65.0 | 80.0 | 85.0 | 90.0 | 92.0 |
| | Judgment of fixability | X | ○ | ○ | ○ | ○ |
| | Print density (LL/HH) | ○/○ | ○/○ | ○/○ | ○/○ | ○/○ |
| | Fogging (LL/HH) | ○/○ | ○/○ | ○/○ | ○/○ | ○/○ |

| Components | Name | Example 24 SCR-6C | Comp. Example 4 SCR-7C | Example 25 SCR-8C | Example 26 SCR-9C | Example 27 SCR-10C |
|---|---|---|---|---|---|---|
| Pigment | IRGALITE RED 3RS (Ciba Geigy) | 10.0 | 10.0 | 10.0 | 10.0 | 10.0 |
| Binder | Polyester resin | 69.0 | 39.0 | 88.0 | 88.0 | 88.0 |
| Charge control agent (CCA) | CCA-100 (CHUO SYNTHETIC CHEMICALS CO., LTD.) | 1.0 | 1.0 | 1.0 | 1.0 | 1.0 |
| Cyanine compound of the present invention (infrared absorbing agent) | CY-10-1 | 20.0 | 50.0 | 0.5 | 0.5 | 0.5 |
| | CY-10-2 | | | | | |
| Other infrared absorbing | IRG-002 | | | 0.5 | | |

TABLE 5-continued

| | | | | | | |
|---|---|---|---|---|---|---|
| agent | IRG-040 | | | | 0.5 | |
| | UUHP | | | | | 0.5 |
| Auxiliary fixing agent | NP105 (Mitsui Chemicals) | 0.5 | 0.5 | 0.5 | 0.5 | 0.5 |
| External additive | H3004 (Clariant) | 0.5 | 0.5 | 0.5 | 0.5 | 0.5 |
| Evaluation | LL charge amount (−μC/g) | 21.5 | 20.6 | 24.6 | 25.6 | 22.5 |
| | HH charge amount (−μC/g) | 15.6 | 5.3 | 20.8 | 20.3 | 20.5 |
| | Ratio HH/LL (charge retention) | 72.6 | 25.7 | 84.6 | 79.3 | 91.1 |
| | Fixation (%) | 93.0 | 100.0 | 95.0 | 96.0 | 94.0 |
| | Judgment of fixability | ○ | ◎ | ◎ | ◎ | ○ |
| | Print density (LL/HH) | ○/○ | ○/○ | ○/○ | ○/○ | ○/○ |
| | Fogging (LL/HH) | ○/○ | ○/X | ○/○ | ○/○ | ○/○ |

Example 28

In this example, a blue color toner for flash fixation was prepared and a printing test was conducted by employing a flash fixing system.

Employing, as the binder resin, a sulfonic acid-modified polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a phthalocyanine pigment (B2G, manufactured by Clariant Co., Ltd.), 3% by weight of a calixarene compound (E-89, manufactured by Orient Chemicals) and 4% by weight of a quinoine derivative compound represented by the following formula:

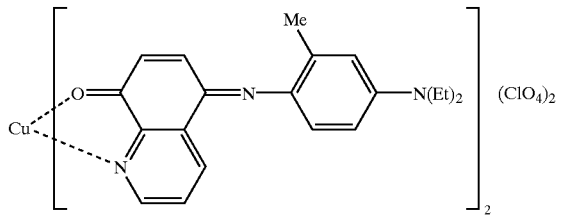

Me: methyl group
Et: ethyl group
were added to the sulfonic acid-modified polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in blue. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −12 μC/g.

Subsequently, the resulting developing agent was set in a high sped printing machine (modification of PS2160, manufactured by Fujitsu Ltd.) and then the toner was fixed on a plain paper (NIP-1500LT, manufactured by Kobayashi Kirokushi Co., Ltd.) by applying Xenon flashlight having a high emission intensity at a wavelength within a range from 700 to 1500 nm to obtain a printed image.

The fixability of the resulting printed image was examined in the following manner. First, the optical density ($OD_1$) was measured in the printed image of 1 inch (25.4 mm) square. Then after sticking an adhesive tape (Scotch™ Mending Tape manufactured by Sumitomo 3M) on the same printed image, the tape was pulled off. Then, the optical density ($OD_2$) of the printed image after pulling off was measured again. A Macbeth PCM meter was used in the measurement of the optical density. The fixation % was calculated by the following equation.

$$\text{Fixation } (\%) = OD_2/OD_1 \times 100$$

As a result, it has been found that the printed image has excellent fixability with the fixation % of 96%. The printed image had good image quality with less stain such as fogging on the background.

Comparative Example 5

The same procedure as in Example 28 was repeated, except that the addition of the quinoline derivative compound was omitted, for comparison.

In the same manner as in Example 28, the charge amount of the developing agent was measured by a blow-off charge amount measuring device (manufactured by Toshiba Chemical). As a result, it has been found that the charge amount is −12 μC/g and comparable with the toner of Example 28. These results showed that the quinoline derivative compound used in Example 28 exerts a small influence on the chargeability of the toner.

Subsequently, the printing test was conducted in the same manner as in Example 28. As a result, it has been found that the resulting printed image has such poor fixability that the image is broken when rubbed with fingers and therefore the toner has a quality that is scarcely fit for practical use. The fixability was 30% or less. These results showed that the quinoline derivative compound used in Example 28 exclusively contributes to the flash fixability

Example 29

In this example, a red color toner for flash fixation was prepared and a printing test was conducted by employing a flash fixing system.

Employing, as the binder resin, a sulfonic acid-modified polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a quinacridon pigment (E-02, manufactured by Clariant Co., Ltd.), 3% by weight of a calixarene compound (E-89, manufactured by Orient Chemicals) and 5% by weight of a quinoine derivative compound represented by the following formula:

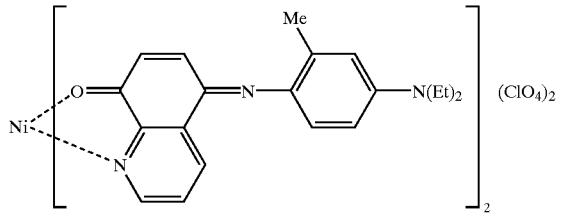

Me: methyl group
Et: ethyl group
were added to the sulfonic acid-modified polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in red. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −12 μC/g.

Furthermore, the resulting developing agent was subjected to the same printing and evaluation tests as in Example 28. As a result, it has been found that the printed image has excellent fixability with the fixation % of 93%. The printed image had good image quality with less stain such as fogging on the background.

Example 30

In this example, a yellow color toner for flash fixation was prepared and a printing test was conducted by employing a flash fixing system.

Employing, as the binder resin, a sulfonic acid-modified polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a benzidine pigment (ECY-204, manufactured by Dainichiseika Color & Chemicals Mfg. Co., Ltd.), 3% by weight of a calixarene compound (E-89, manufactured by Orient Chemicals) and 4% by weight of a quinoine derivative compound represented by the following formula:

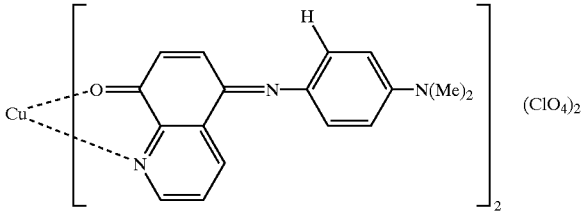

Me: methyl group
were added to the sulfonic acid-modified polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in yellow. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −12 μC/g.

Furthermore, the resulting developing agent was subjected to the same printing and evaluation tests as in Example 28. As a result, it has been found that the printed image has excellent fixability with the fixation % of 90%. The printed image had good image quality with less stain such as fogging on the background.

Example 31

In this example, a blue color toner for flash fixation was prepared and a printing test was conducted by employing a flash fixing system.

Employing, as the binder resin, a sulfonic acid-modified polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a phthalocyanine pigment (B2G, manufactured by Clariant Co., Ltd.), 3% by weight of a calixarene compound (E-89, manufactured by Orient Chemicals) and 4% by weight of a quinoine derivative compound represented by the following formula:

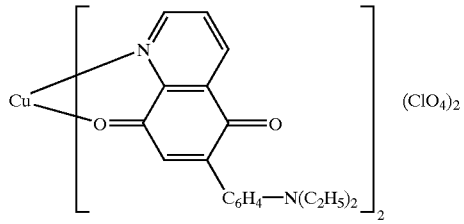

were added to the sulfonic acid-modified polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in blue. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −14 μC/g.

Subsequently, the resulting developing agent was set in a high sped printing machine (modification of PS2160, manufactured by Fujitsu Ltd.) and then the toner was fixed on a plain paper (NIP-1500LT, manufactured by Kobayashi Kirokushi Co., Ltd.) by applying a Xenon flash having a high emission intensity at a wavelength within a range from 700 to 1500 nm to obtain a printed image.

The fixability of the resulting printed image was examined in the following manner. First, the optical density ($OD_1$) was measured in the printed image of 1 inch (25.4 mm) square. Then after sticking an adhesive tape (Scotch™ Mending Tape manufactured by Sumitomo 3M) on the same printed image, the tape was pulled off. Then, the optical density ($OD_2$) of the printed image after pulling off was-measured again. A Macbeth PCM meter was used in the measurement of the optical density. The fixation % was calculated by the following equation.

$$\text{Fixation } (\%) = OD_2/OD_1 \times 100$$

As a result, it has been found that the printed image has excellent fixability with a fixation % of 97%. The printed image had good image quality with less stain such as fogging on the background.

Comparative Example 6

The same procedure as in Example 31 was repeated, except that the addition of the quinoline derivative compound was omitted, for comparison.

In the same manner as in Example 31, the charge amount of the developing agent was measured by a blow-off charge amount measuring device (manufactured by Toshiba Chemical). As a result, it has been found that the charge amount is −13 μC/g and comparable with the toner of Example 31. These results showed that the quinoline derivative compound used in Example 31 exerts a small influence on the chargeability of the toner.

Subsequently, the printing test was conducted in the same manner as in Example 31. As a result, it has been found that the resulting printed image has such poor fixability that the image is broken when rubbed with fingers and therefore the toner has a quality that is scarcely fit for practical use. The fixability was 30% or less. These results showed that the quinoline derivative compound used in Example 31 exclusively contributes to the flash fixability of the toner.

Example 32

In this example, a red color toner for flash fixation was prepared and a printing test was conducted by employing a flash fixing system.

Employing, as the binder resin, a sulfonic acid-modified polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a quinacridon pigment (E-02, manufactured by Clariant Co., Ltd.), 3% by weight of a calixarene compound (E-89, manufactured by Orient Chemicals) and 5% by weight of a quinoine derivative compound represented by the following formula:

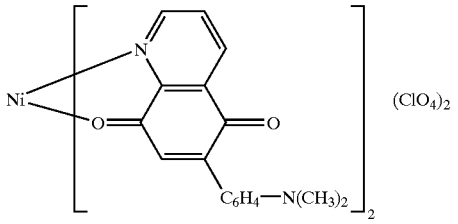

were added to the sulfonic acid-modified polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in red. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −14 μC/g.

Furthermore, the resulting developing agent was subjected to the same printing and evaluation tests as in Example 31. As a result, it has been found that the printed image has excellent fixability with the fixation % of 95%. The printed image had good image quality with less stain such as fogging on the background.

Example 33

In this example, a yellow color toner for flash fixation was prepared and a printing test was conducted by employing a flash fixing system.

Employing, as the binder resin, a sulfonic acid-modified polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a benzidine pigment (ECY-204, manufactured by Dainichiseika Color & Chemicals Mfg. Co., Ltd.), 3% by weight of a calixarene compound (E-89, manufactured by Orient Chemicals) and 4% by weight of a quinoine derivative compound represented by the following formula:

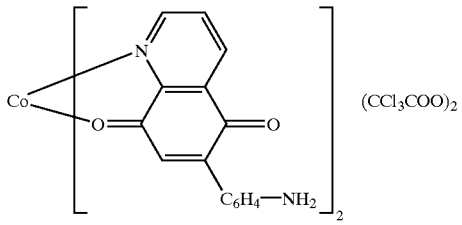

were added to the sulfonic acid-modified polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in yellow. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −15 μC/g.

Furthermore, the resulting developing agent was subjected to the same printing and evaluation tests as in Example 31. As a result, it has been found that the printed image has excellent fixability with the fixation % of 95%. The printed image had good image quality with less stain such as fogging on the background.

Preparation Example 3

(1) Preparation of carrier

In the same manner as in Preparation Example 1, a magnetite carrier was prepared.

(2) Preparation of polyester resin

In the same manner as in Preparation Example 1, a polyester resin having a weight-average molecular weight of 5,000, a glass transition temperature of 65° C., a softening point of 110° C. and an acid value of 20 mg/KOH was prepared.

(3) Preparation of color toner

Red color toners for flash fixation having different compositions shown in Table 7 were prepared. In the table, the polymethine compound used as the infrared absorbing agent is summarized in Table 6. With respect to infrared absorbing agents (commercially available products) used in combination with the polymethine compound, refer to Table 1 described above.

Preparation of Toner SCR-1N:

As described in Table 7 below, 0.05 parts by weight of the polymethine compound (NK-3519) of the present invention, 89 parts by weight of a polyester resin, 10 parts by weight of IRGALITE RED 3RS (manufactured by Ciba Geigy), 1 part by weight of a charge control agent (CCA-100, manufactured by CHUO SYNTHETIC CHEMICALS CO., LTD.) and 0.5 parts by weight of charge a wax, NP105 (manufactured by Mitsui Chemicals) were prepared as toner components. All the toner components were charged in a Henschel mixer for preliminary mixing. Then the mixture was melted and kneaded in an extruder. After cooling the mixture to solidify it, the solid mixture was ground by a hammer mill and then ground into fine powder in a jet mill.

The fine powder thus obtained was classified by an air flow classifier, thereby to obtain fine particles colored in red having a volume-average particle diameter of 8.5 μm. To the fine particles of toner thus obtained, 0.5 parts by weight of hydrophobic fine silica particles (H3004 manufactured by Clariant Japan Co., Ltd.) were externally added in the Henschel mixer. As a result, a toner SCR-1N was obtained.

Preparation of Toners SCR-2N to SCR-11N:

In the same manner as in case of the preparation of the toner SCR-LN, toners were prepared except that the materials and each amount thereof were changed to those described in Table 7 described below. After the fine particles colored in red having a volume-average particle diameter of 8.5 μm were obtained, external additives were added. As a result, toners SCR-2N to SCR-11N were obtained.

Examples 34 to 41 and Comparative Examples 7 to 9

Toners SCR-LN to SCR-11N prepared as described above were used in the printing test employing the flash fixing system. The procedure of the printing test is the same as that employed in Examples 1 to 16.

4.5% by weight of each of the toners described above was mixed with 95.5% by weight of the carrier prepared as described above, thereby to make a developing agent. The developing agent was set in a high sped printing machine (modification of PS2160 manufactured by Fujitsu Ltd.) having a Xenon lamp as the fixing light source. Then lines were printed at the energy of fixing light of 2.2 J/cm$^2$ and a printing rate of 8,000 lines/min. on a plain paper (NIP-1500LT, manufactured by Kobayashi Kirokushi Co., Ltd.) used as the recording medium. Prints thus obtained were evaluated for the following performance:

(1) Charge amount (high temperature/high humidity HH and low temperature/low humidity LL)
(2) Ratio of charge amount (charge retention)
(3) Fixation % of toner
(4) Fixability
(5) Print density
(6) Fogging The results of the measurements and evaluations shown in Table 7 were obtained.

TABLE 6

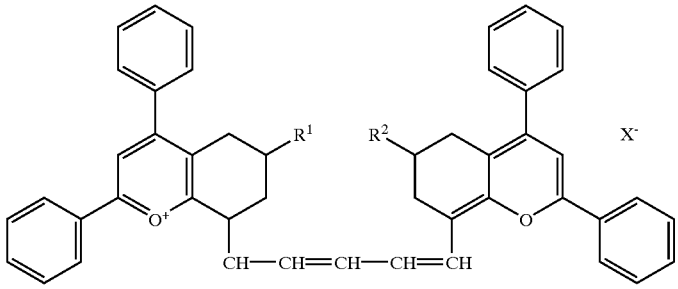

| Infrared absorbing agent | $R^1$ | $R^2$ | X | Manufacturer | Maximum infrared absorption wavelength (nm)[1)] |
|---|---|---|---|---|---|
| NK-3519 | $CH_3$ | $CH_3$ | $B^-$ | Nihon Photosensitive Pigment Research | 1060 |

[1)]in acetone solvent

TABLE 7

| Components | | Name | Comp. Example 7 SCR-1N | Example 34 SCR-2N | Example 35 SCR-3N | Example 36 SCR-4N | Example 37 SCR-5N | Example 38 SCR-6N |
|---|---|---|---|---|---|---|---|---|
| Pigment | | IRGALITE RED 3RS (Ciba Geigy) | 10.0 | 10.0 | 10.0 | 10.0 | 10.0 | 10.0 |
| Binder | | Polyester resin | 89.0 | 88.7 | 88.5 | 88.0 | 79.0 | 69.0 |
| Charge control agent (CCA) | | CCA-100 (CHUO SYNTHETIC CHEMICALS CO., LTD.) | 1.0 | 1.0 | 1.0 | 1.0 | 1.0 | 1.0 |
| Infrared absorbing agent | Polymethine compound | NK-3519 | 0.05 | 0.3 | 0.5 | 1.0 | 10.0 | 20.0 |
| | Other IR absorbing agent than polymethine compound | IRG-002 | | | | | | |
| | | IRG-040 | | | | | | |
| | | UUHP | | | | | | |
| | Other polymethine compound | IRB20 | | | | | | |
| Auxiliary fixing agent | | NP105 (Mitsui Chemicals) | 0.5 | 0.5 | 0.5 | 0.5 | 0.5 | 0.5 |
| External additive | | H3004 (Clariant) | 0.5 | 0.5 | 0.5 | 0.5 | 0.5 | 0.5 |
| Evaluation | | LL charge amount (−μC/g) | 26.2 | 24.7 | 24.1 | 23.5 | 22.6 | 21.6 |
| | | HH charge amount (−μC/g) | 24.7 | 21.5 | 20 | 18.7 | 17.4 | 15.5 |
| | | Ratio HH/LL (charge retention) | 94.3 | 87.0 | 83.0 | 79.6 | 77.0 | 71.8 |

TABLE 7-continued

| | | | | | | | |
|---|---|---|---|---|---|---|---|
| | | Fixation (%) | 64.7 | 82.3 | 85.1 | 88.6 | 91.7 | 93.5 |
| | | Judgment of fixability | X | ○ | ○ | ○ | ○ | ○ |
| | | Print density (LL/HH) | ○/○ | ○/○ | ○/○ | ○/○ | ○/○ | ○/○ |
| | | Fogging (LL/HH) | ○/○ | ○/○ | ○/○ | ○/○ | ○/○ | ○/○ |

| Components | | Name | Comp. Example 8 SCR-7N | Example 39 SCR-8N | Example 40 SCR-9N | Example 41 SCR-10N | Comp. Example 9 SCR-11N |
|---|---|---|---|---|---|---|---|
| Pigment | | IRGALITE RED 3RS (Ciba Geigy) | 10.0 | 10.0 | 10.0 | 10.0 | 10.0 |
| Binder | | Polyester resin | 59.0 | 88.0 | 88.0 | 88.0 | 88.0 |
| Charge control agent (CCA) | | CCA-100 (CHUO SYNTHETIC CHEMICALS CO., LTD.) | 1.0 | 1.0 | 1.0 | 1.0 | 1.0 |
| Infrared absorbing agent | Polymethine compound | NK-3519 | 30.0 | 0.5 | 0.5 | 0.5 | 0.5 |
| | Other IR absorbing agent than polymethine compound | IRG-002 | | 0.5 | | | |
| | | IRG-040 | | | 0.5 | | |
| | | UUHP | | | | 0.5 | |
| | Other polymethine compound | IRB20 | | | | | 0.5 |
| Auxiliary fixing agent | | NP105 (Mitsui Chemicals) | 0.5 | 0.5 | 0.5 | 0.5 | 0.5 |
| External additive | | H3004 (Clariant) | 0.5 | 0.5 | 0.5 | 0.5 | 0.5 |
| Evaluation | | LL charge amount (−μC/g) | 20.4 | 24.6 | 25.6 | 22.5 | 21.8 |
| | | HH charge amount (−μC/g) | 5.7 | 20.8 | 20.3 | 20.5 | 16.8 |
| | | Ratio HH/LL (charge retention) | 27.9 | 84.6 | 79.3 | 91.1 | 77.1 |
| | | Fixation (%) | 99.7 | 94.5 | 96.0 | 93.8 | 93.3 |
| | | Judgment of fixability | ◎ | ◎ | ◎ | ○ | ○ |
| | | Print density (LL/HH) | ○/○ | ○/○ | ○/○ | ○/○ | ○/○ |
| | | Fogging (LL/HH) | ○/X | ○/○ | ○/○ | ○/○ | ○/X |

Example 42

In this example, a blue color toner for flash fixation was prepared and a printing test was conducted by employing a flash fixing system.

Employing, as the binder resin, a sulfonic acid-modified polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a phthalocyanine pigment (B2G, manufactured by Clariant Co., Ltd.), 3% by weight of a calixarene compound (E-89, manufactured by Orient Chemicals) and 4% by weight of a benzene-nickel complex compound represented by the following formula:

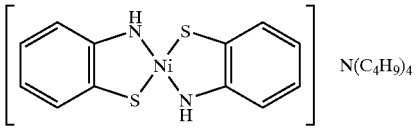

were added to the sulfonic acid-modified polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in blue. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −12 μC/g.

Subsequently, the resulting developing agent was set in a high sped printing machine (modification of PS2160, manufactured by Fujitsu Ltd.) and then the toner was fixed on a plain paper (NIP-1500LT, manufactured by Kobayashi Kirokushi Co., Ltd.) by applying Xenon flashlight having a high emission intensity at a wavelength within a range from 700 to 1500 nm to obtain a printed image.

The fixability of the resulting printed image was examined in the following manner. First, the optical density ($OD_1$) was measured in the printed image of 1 inch (25.4 mm) square. Then after sticking an adhesive tape (Scotch™ Mending Tape manufactured by Sumitomo 3M) on the same printed image, the tape was pulled off. Then, the optical density ($OD_2$) of the printed image after pulling off was measured again. A Macbeth PCM meter was used in the measurement of the optical density. The fixation % was calculated by the following equation.

$$\text{Fixation } (\%) = OD_2/OD_1 \times 100$$

As a result, it has been found that the printed image has excellent fixability with the fixation % of 95%. The printed image had good image quality with less stain such as fogging on the background.

Comparative Example 10

The same procedure as in Example 42 was repeated, except that the addition of the benzene-nickel complex compound was omitted, for comparison.

In the same manner as in Example 42, the charge amount of the developing agent was measured by a blow-off charge amount measuring device (manufactured by Toshiba Chemical). As a result, it has been found that the charge amount is −12 μC/g and comparable with the toner of Example 42. These results showed that the benzene-nickel complex compound used in Example 42 exerts a small influence on the chargeability of the toner.

Subsequently, the printing test was conducted in the same manner as in Example 42. As a result, it has been found that the resulting printed image has such poor fixability that the image is broken when rubbed with fingers and therefore the toner has a quality that is scarcely fit for practical use. The fixability was 30% or less. These results showed that the benzene-nickel complex compound used in Example 42 exclusively contributes to the flash fixability.

Comparative Example 11

The same procedure as in Example 42 was repeated, except that 1 part by weight of the infrared absorbing agent bis(1,2'-diphenyselen-1,2-dithio)nickel described in Example 2 of Japanese Unexamined Patent Publication (Kokai) No. 11-125928 was used in place of the benzene-nickel complex compound, for comparison.

In the same manner as in Example 42, the charge amount of the developing agent was measured by a blow-off charge amount measuring device (manufactured by Toshiba Chemical). As a result, it has been found that the charge amount is −20 μC/g and is quite different from that in the case of the toner of Example 42.

Subsequently, the printing test was conducted in the same manner as in Example 42. As a result, it has been found that the resulting printed image has such poor fixability that the image is broken when rubbed with fingers and therefore the toner has a quality that is scarcely fit for practical use. The fixability was 30% or less. These results showed that the benzene-nickel complex compound used in Example 42 is superior in flash fixability of the toner to the product of the prior art.

Comparative Example 12

The same procedure as in Example 42 was repeated, except that the sulfonic acid-modified polyester resin (binder resin) was used after dissolution as described in Japanese Unexamined Patent Publication (Kokai) No. 11-38666 in place of dispersion of Example 42, for comparison.

In the same manner as in Example 42, the charge amount of the developing agent was measured by a blow-off charge amount measuring device (manufactured by Toshiba Chemical). As a result, it has been found that the charge amount is about 6 μC/g lower than that of the toner of Example 42. In the same manner as in Example 42, the printing test was conducted. As a result, the fogging occurred in the resulting printed image. These results showed that, when using the benzene-nickel complex compound in Example 42, dispersion of the binder resin is effective to prevent fogging because of an increase in charge amount as compared with the case of dissolving the binder resin.

Example 43

In this example, a blue color toner for flash fixation was prepared and a printing test was conducted by employing a flash fixing system.

Employing, as the binder resin, a polyester resin having an acid value of 30 mg/KOH and a softening temperature of 104° C., comprising terephthalic acid, an ethylene oxide adduct of bisphenol A and bis(4-hydroxyphenyl)sulfonic acid as essential constituent monomers, 5% by weight of a phthalocyanine pigment (B2G, manufactured by Clariant Co., Ltd.), 3% by weight of a calixarene compound (E-89, manufactured by Orient Chemicals) and 4% by weight of zirconium carbide (ZrC) were added to the polyester resin, and then the mixture was melt-kneaded, ground and classified to obtain a toner matrix having an average particle diameter of 9 μm.

To the resulting toner matrix, 0.35 parts by weight of a hydrophobic silica (H-2000, manufactured by Clariant Co., Ltd.) as an external additive was added to obtain a toner colored in blue. This toner was mixed with a ferrite carrier having a particle diameter of 60 μm in a toner concentration of 4.5% to prepare a developing agent. The charge amount of the developing agent was measured by a blow-off charge amount measuring device (manufactured by Toshiba Chemical). As a result, the charge amount was −12 μC/g.

Subsequently, the resulting developing agent was set in a high sped printing machine (modification of PS2160, manufactured by Fujitsu Ltd.) and then the toner was fixed on a plain paper (NIP-1500LT, manufactured by Kobayashi Kirokushi Co., Ltd.) by applying a Xenon flashlight having a high emission intensity at a wavelength within a range from 700 to 1500 nm to obtain a printed image.

The fixability of the resulting printed image was examined in the following manner. First, the optical density ($OD_1$) was measured in the printed image of 1 inch (25.4 mm) square. Then after sticking an adhesive tape (Scotch™ Mending Tape manufactured by Sumitomo 3M) on the same printed image, the tape was pulled off. Then, the optical density ($OD_2$) of the printed image after pulling off was measured again. A Macbeth PCM meter was used in the measurement of the optical density. The fixation % was calculated by the following equation.

$$\text{Fixation } (\%) = OD_2/OD_1 \times 100$$

As a result, it has been found that the printed image has excellent fixability with the fixation % of 90%. The printed image had good image quality with less stain such as fogging on the background.

Comparative Example 13

The same procedure as in Example 43 was repeated, except that the addition of zirconium carbide was omitted, for comparison.

In the same manner as in Example 43, the charge amount of the developing agent was measured by a blow-off charge amount measuring device (manufactured by Toshiba Chemical). As a result, it has been found that the charge amount is −12 μC/g and is comparable with the toner of Example 43. These results showed that the zirconium carbide used in Example 43 exerts a small influence on the chargeability of the toner.

Subsequently, the printing test was conducted in the same manner as in Example 43. As a result, it has been found that the resulting printed image has such poor fixability that the image is broken when rubbed with fingers and therefore the toner has a quality that is scarcely fit for practical use. The fixability was 30% or less. These results showed that zirconium carbide used in Example 43 contributes to the flash fixability of the toner.

Comparative Example 14

The same procedure as in Example 43 was repeated, except that zirconium carbide was externally added to the toner matrix prepared by adding no zirconium carbide, together with the hydrophobic silica, in place of preparation of the toner matrix by the addition of zirconium carbide to the polyester resin, for comparison. The amount of zirconium carbide externally added was 4% by weight, similar to Example 43.

Subsequently, the printing test was conducted in the same manner as in Example 43. The resulting printed image has such poor fixability that the image is broken when rubbed with fingers and therefore the toner has a quality that is scarcely fit for practical use.

As can be appreciated from the above description, according to the present invention, since the photofixing system can be used for fixing images, blur and dust of the image do not occur in the fixing step and degradation of imaging resolution (reproducibility) can be prevented. The process can be quick-started because warming up using a heat source is not required. The recording paper does not catch fire due to the heat generated by the heat source, even when the recording paper jams in the fixing device due to a system breakdown or other trouble. Fixation can be conducted regardless of the type of material and thickness of the recording medium such as glued paper, preprint paper and sheets of paper having different thicknesses.

According to the present invention, as the photofixing system can be used, there can be provided a color toner for forming an image which is superior in fixability of the color toner, and also which can achieve a long lifetime due to charge stabilization and environmental stabilization.

According to the present invention, there can be provided a color toner for forming an image, which allows use of the photofixing system for fixing images without forming voids and is superior in fixability of the color toner, and also which can maintain stable charge and developing properties for a long period because of less variation in charge amount due to an infrared absorbing agent used, and causes less influence on color hue due to the infrared absorbing agent.

According to the present invention, there can be provided a color image forming method, which allows use of the photofixing system for fixing images and is superior in fixability of the color toner, and also which can achieve long lifetime due to charge stabilization and environmental stabilization.

According to the present invention, there can be provided a color image forming apparatus, which allows use of the photofixing system for fixing images and is superior in fixability of the color toner, and also which can achieve long lifetime due to charge stabilization and environmental stabilization.

What is claimed is:

1. A color toner for forming an image, comprising at least a binder resin and a colorant, which is used in an image forming method employing a photofixing system, said color toner further comprising at least one additive selected from the group consisting of:

(1) light-absorbing fine composite particles comprising core particles and at least two coating layers having different refractive indexes laminated on the surface of the core particles;

(2) an azulene compound represented by the following general formula (I):

(I)

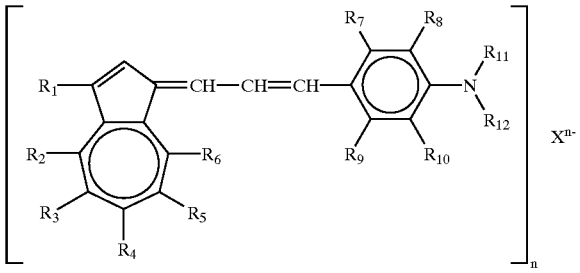

wherein $R_1$ to $R_{12}$ may be the same or different and each represents a hydrogen atom, or a substituted or unsubstituted, saturated or unsaturated, aliphatic hydrocarbon group, X represents an anion, and n represents a positive integer;

(3) a cyanine compound represented by the following general formula (II):

(II)

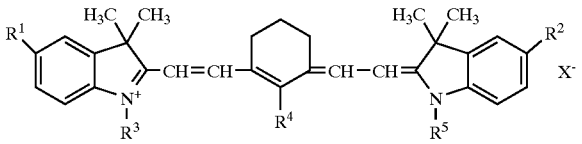

wherein $R^1$ to $R^5$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(4) a quinoline compound represented by the following general formula (III):

(III)

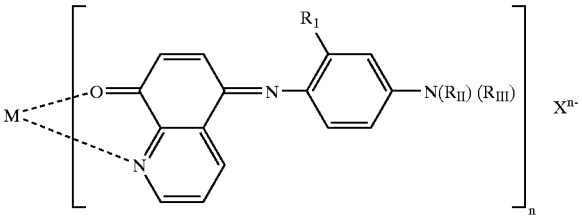

wherein $R_I$ represents a hydrogen atom, a halogen atom, or a monovalent substituent, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(5) a quinoline compound represented by the following general formula (IV):

(IV)

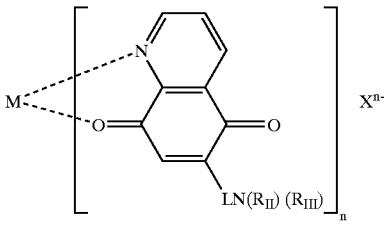

wherein L represents a bonding group, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(6) a polymethine compound represented by the following general formula (V):

(V)

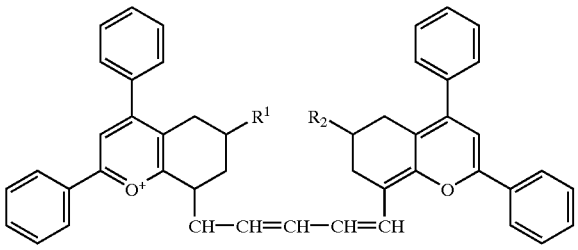

wherein $R^1$ and $R^2$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(7) a benzene metal complex represented by the following general formula (VI):

(VI)

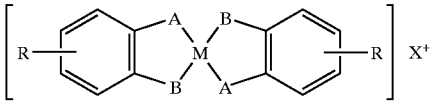

wherein R represents a monovalent substituent, A and B may be the same or different and each represents a sulfur atom, a selenium atom, or —NH, M represents a transition metal atom, and X represents a cation; and (8) a photothermal conversion ceramic.

2. The color toner for forming an image according to claim 1, wherein the additive shows a light absorption peak at a wavelength ranging from 750 to 1200 nm.

3. The color toner for forming an image according to claim 1 or 2, wherein in the light-absorbing fine composite particles, the core particles are iron powders, ferrite powders, suspended resin particles or glass beads.

4. The color toner for forming an image according to claim 1 or 2, wherein in the light-absorbing fine composite particles, the particle diameter of the core particles is within a range from 0.01 to 5 $\mu$m.

5. The color toner for forming an image according to claim 1 or 2, wherein in the light-absorbing fine composite particles, the coating layer comprises an oxide of iron, nickel, chromium, titanium, aluminum, silicon, calcium, magnesium, barium or zinc, or a composite oxide thereof.

6. The color toner for forming an image according to claim 1 or 2, wherein the light-absorbing fine composite particles are added in the amount within a range from 0.01 to 10 parts by weight based on 100 parts by weight of the toner when externally added to the toner.

7. The color toner for forming an image according to claim 1 or 2, wherein the light-absorbing fine composite particles are added in the amount within a range from 0.1 to 40 parts by weight based on 100 parts by weight of the toner when internally added to the toner.

8. The color toner for forming an image according to claim 1 or 2, wherein the azulene compound represented by the formula (I) is added in the amount within a range from 0.5 to 5.0 parts by weight based on 100 parts by weight of the toner.

9. The color toner for forming an image according to claim 1 or 2, wherein the cyanine compound represented by the formula (II) is added in the amount within a range from 0.1 to 20.0 parts by weight based on 100 parts by weight of the toner.

10. The color toner for forming an image according to claim 1 or 2, wherein the quinoline compound represented by the formula (III) is added in the amount within a range from 0.1 to 20.0 parts by weight based on 100 parts by weight of the toner.

11. The color toner for forming an image according to claim 1 or 2, wherein the quinoline compound represented by the formula (IV) is added in the amount within a range from 0.1 to 20.0 parts by weight based on 100 parts by weight of the toner.

12. The color toner for forming an image according to claim 1 or 2, wherein the polymethine compound represented by the formula (V) is added in the amount within a range from 0.1 to 20.0 parts by weight based on 100 parts by weight of the toner.

13. The color toner for forming an image according to claim 1 or 2, wherein the benzene metal complex represented by the formula (VI) is added in the amount within a range from 0.1 to 20.0 parts by weight based on 100 parts by weight of the toner.

14. The color toner for forming an image according to claim 1 or 2, wherein the photothermal conversion ceramic comprises zirconium carbide.

15. The color toner for forming an image according to claim 1 or 2, wherein the photothermal conversion ceramic is added in the amount within a range from 0.1 to 20.0 parts by weight based on 100 parts by weight of the toner when internally added to the toner.

16. The color toner for forming an image according to claim 1 or 2, further comprising an inorganic and/or organic infrared absorbing agent.

17. The color toner for forming an image according to claim 1 or 2, wherein the binder resin is a polyester which contains a bisphenol A derivative as a main component.

18. The color toner for forming an image according to claim 1 or 2, which is an electrophotographic color toner.

19. A method of forming a color image on a recording medium by means of an electrophotographic system which comprises the steps of forming an electrostatic latent image by image exposure, visualizing the electrostatic latent image by development, transferring the visualized image onto the recording medium and fixing the transferred image, wherein a developing agent used in the step of developing the electrostatic latent image contains a color toner comprising at least a binder resin and a colorant, which is used in an image forming method employing a photofixing system, said color toner further comprising at least one additive selected from the group consisting of:

(1) light-absorbing fine composite particles comprising core particles and at least two coating layers having different refractive indexes laminated on the surface of the core particles;

(2) an azulene compound represented by the following general formula (I):

(I)

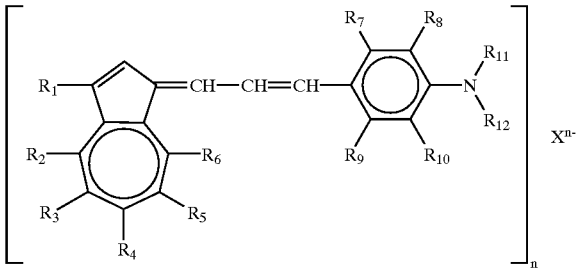

wherein $R_1$ to $R_{12}$ may be the same or different and each represents a hydrogen atom, or a substituted or unsubstituted, saturated or unsaturated, aliphatic hydrocarbon group, X represents an anion, and n represents a positive integer;

(3) a cyanine compound represented by the following general formula (II):

(II)

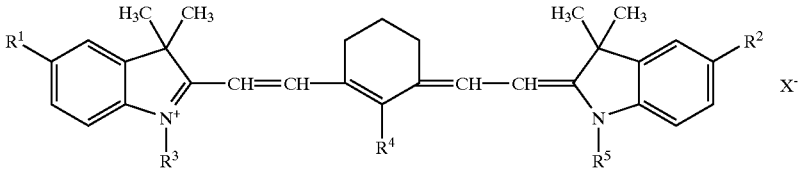

wherein $R^1$ to $R^5$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(4) a quinoline compound represented by the following general formula (III):

(III)

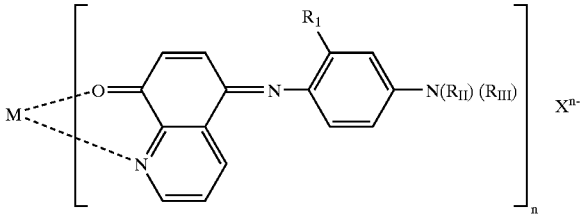

wherein $R_I$ represents a hydrogen atom, a halogen atom, or a monovalent substituent, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(5) a quinoline compound represented by the following general formula (IV):

(IV)

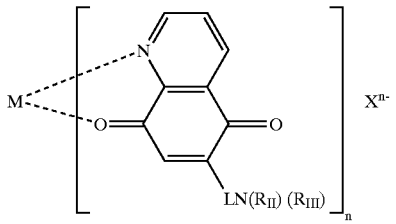

wherein L represents a bonding group, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(6) a polymethine compound represented by the following general formula (V):

(V)

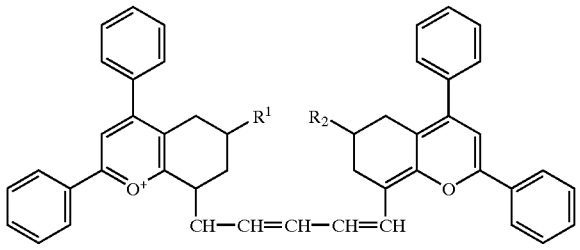

wherein $R^1$ and $R^2$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(7) a benzene metal complex represented by the following general formula (VI):

(VI)

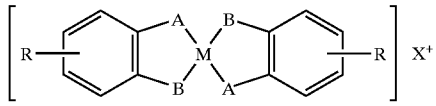

wherein R represents a monovalent substituent, A and B may be the same or different and each represents a sulfur atom, a selenium atom, or —NH, M represents a transition metal atom, and X represents a cation; and (8) a photothermal conversion ceramics; and photofixation is conducted at a light emission energy density ranging from 1.0 to 6.0 J/cm$^2$ in the step of fixing the transferred image after transferring the image visualized by using the developing agent onto the recording medium.

20. An apparatus for forming a color image on a recording medium by means of an electrophotographic system, comprising an image exposing device for forming an electrostatic latent image, a developing device for visualizing the electrostatic latent image, an image transferring device for transferring the visualized image onto the recording medium, and an image fixing device for fixing the transferred image onto the recording medium, wherein the developing device is loaded with a developing agent comprising a color toner which comprises at least a binder resin and a colorant, said color toner further comprising at least one additive selected from the group consisting of:

(1) light-absorbing fine composite particles comprising core particles and at least two coating layers having different refractive indexes laminated on the surface of the core particles;

(2) an azulene compound represented by the following general formula (I):

(I)

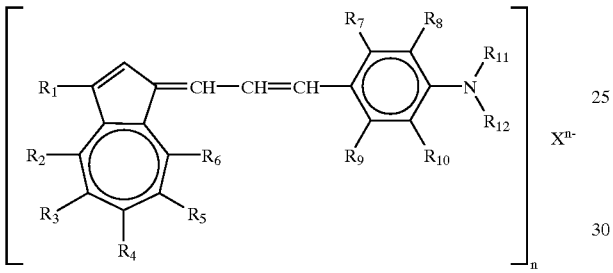

wherein $R_1$ to $R_{12}$ may be the same or different and each represents a hydrogen atom, or a substituted or unsubstituted, saturated or unsaturated, aliphatic hydrocarbon group, X represents an anion, and n represents a positive integer;

(3) a cyanine compound represented by the following general formula (II):

(II)

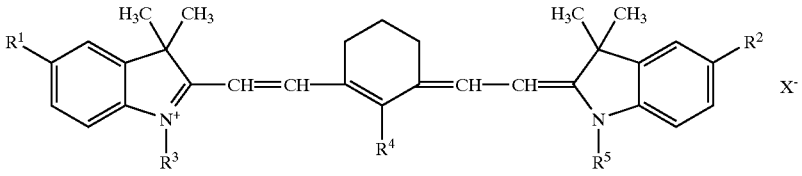

wherein $R^1$ to $R^5$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(4) a quinoline compound represented by the following general formula (III):

(III)

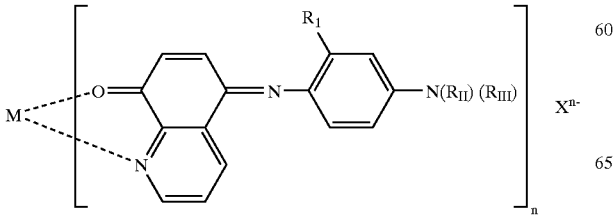

wherein $R_I$ represents a hydrogen atom, a halogen atom, or a monovalent substituent, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(5) a quinoline compound represented by the following general formula (IV):

(IV)

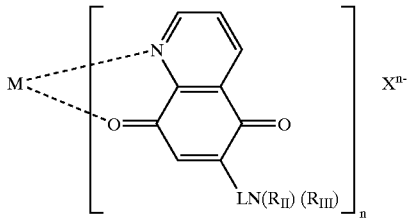

wherein L represents a bonding group, $R_{II}$ and $R_{III}$ may be the same or different and each represents a hydrogen atom, or a substituted or unsubstituted, saturated or unsaturated, aliphatic hydrocarbon group, M represents a transition metal atom, X represents an anion, and n represents a positive integer;

(6) a polymethine compound represented by the following general formula (V):

(V)

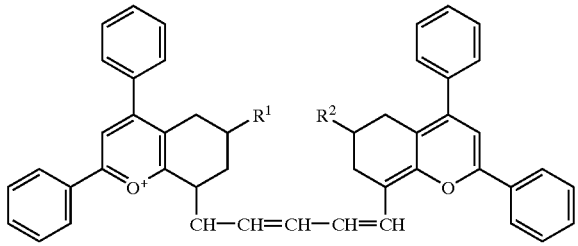

wherein $R^1$ and $R^2$ may be the same or different and each represents a hydrogen atom, a substituted or unsubstituted, saturated or unsaturated, aliphatic hydrocarbon group, an alicyclic hydrocarbon group, an aromatic hydrocarbon group, or an aromatic hydrocarbon group having an aliphatic hydrocarbon side chain, and X represents an anion;

(7) a benzene metal complex represented by the following general formula (VI):

(VI)

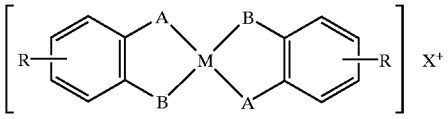

wherein R represents a monovalent substituent, A and B may be the same or different and each represents a sulfur atom, a selenium atom, or —NH, M represents a transition metal atom, and X represents a cation; and (8) a photothermal conversion ceramic; and the image fixing device is provided with a photofixing device having a light emission energy density ranging from 1.0 to 6.0 J/cm$^2$.

* * * * *